US012318011B2

(12) United States Patent
Alletto, Jr.

(10) Patent No.: US 12,318,011 B2
(45) Date of Patent: Jun. 3, 2025

(54) CUSTOMIZABLE MATTRESS

(71) Applicant: BEDGEAR, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 474 days.

(21) Appl. No.: 17/470,252

(22) Filed: Sep. 9, 2021

(65) Prior Publication Data

US 2021/0401187 A1 Dec. 30, 2021

Related U.S. Application Data

(62) Division of application No. 15/220,964, filed on Jul. 27, 2016, now abandoned.

(60) Provisional application No. 62/200,378, filed on Aug. 3, 2015.

(51) Int. Cl.

| | |
|---|---|
| ***A47C 27/04*** | (2006.01) |
| ***A47C 23/00*** | (2006.01) |
| ***A47C 27/00*** | (2006.01) |
| ***A47C 27/05*** | (2006.01) |
| ***A47C 27/06*** | (2006.01) |
| ***A47C 27/07*** | (2006.01) |

(52) U.S. Cl.

CPC ..... *A47C 27/001* (2013.01); *A47C 23/002* (2013.01); *A47C 27/053* (2013.01); *A47C 27/062* (2013.01); *A47C 27/064* (2013.01); *A47C 27/07* (2013.01)

(58) Field of Classification Search

CPC ... A47C 27/04; A47C 27/045; A47C 27/0453; A47C 27/0456; A47C 27/001; A47C 27/053; A47C 27/062; A47C 27/064; A47C 27/07; A47C 23/002

See application file for complete search history.

(56) References Cited

U.S. PATENT DOCUMENTS

| | | | | |
|---|---|---|---|---|
| 2,651,788 | A * | 9/1953 | Forwood | A47C 27/15 5/1 |
| 3,308,492 | A * | 3/1967 | Lovette | A47C 27/001 5/722 |
| 4,234,983 | A | 11/1980 | Stumpf | |
| 4,388,738 | A * | 6/1983 | Wagner | A47C 21/048 5/738 |

(Continued)

FOREIGN PATENT DOCUMENTS

| | | | |
|---|---|---|---|
| CA | 2889930 | A1 | 8/2019 |
| WO | 2008145185 | A1 | 12/2008 |

OTHER PUBLICATIONS

Canadian Intellectual Property Office, 2nd Office Action, Application No. 2,994,697, Title : Customizable Mattress, Dated: May 1, 2023.

(Continued)

*Primary Examiner* — Justin C Mikowski
*Assistant Examiner* — Ifeolu A Adeboyejo
(74) *Attorney, Agent, or Firm* — Sorell, Lenna & Schmidt, LLP

(57) ABSTRACT

A customizable mattress includes a chassis defining a cavity. A spring pack is removably positioned within the cavity. A top pad removably covers at least a portion of the spring pack. In some embodiments, kits and methods of use are provided.

17 Claims, 32 Drawing Sheets

(56) References Cited

U.S. PATENT DOCUMENTS

| | | | | | |
|---|---|---|---|---|---|
| 4,424,600 | A * | 1/1984 | Callaway | A47C 27/18 | 5/500 |
| 4,449,261 | A * | 5/1984 | Magnusson | A47C 27/066 | 5/722 |
| 4,970,743 | A | 11/1990 | Wride et al. | | |
| 4,998,310 | A * | 3/1991 | Olson | A47C 27/18 | 5/710 |
| 5,564,141 | A * | 10/1996 | Anderson | A47C 27/085 | 5/678 |
| 5,699,998 | A | 12/1997 | Zysman | | |
| 5,701,621 | A * | 12/1997 | Landi | B29D 99/0089 | 428/116 |
| 7,640,611 | B1 * | 1/2010 | Kluft | A47C 27/064 | 5/718 |
| 7,861,342 | B1 | 1/2011 | Huang | | |
| 8,584,277 | B1 | 11/2013 | Roberts | | |
| 8,978,183 | B1 | 3/2015 | Richmond et al. | | |
| 9,962,008 | B1 * | 5/2018 | Omiste | A47C 21/048 | |
| 9,974,395 | B2 | 5/2018 | Pennington et al. | | |
| 2007/0017033 | A1 * | 1/2007 | Antinori | A47C 23/0522 | 5/727 |
| 2010/0287707 | A1 * | 11/2010 | Beard | A47C 27/081 | 5/706 |
| 2013/0091634 | A1 | 4/2013 | Shearon | | |
| 2013/0110669 | A1 | 5/2013 | Howard | | |
| 2014/0052570 | A1 | 2/2014 | Roberts et al. | | |
| 2022/0061543 | A1 * | 3/2022 | Sylvain | A47C 27/121 | |

OTHER PUBLICATIONS

European Patent Office, Rijswijk, Netherlands, Communication from the Examining Division, Examination Report, Application No. 16833544.6, dated Apr. 19, 2021 Applicant: Bedgear, LLC.

ILPO Israel Patent Office, Agudat Hasport Hapoel 1, Jerusalem, Eshel Bldg (No. 5), Office Action, Jun. 4, 2021, Israeli Patent App. No. 257333.

European Examination Report, EP 1 6833544.6 mailed Jun. 16, 2020.

Supplementary Partial European Search Report, EP 1 6833544.6.

International Search Report issued in Intl. Appl. No. PCT/16/44224, Intl. Filing Date Jul. 27, 2016, mailed from ISA/ Oct. 26.

China Office Action. China National Intellectual Property Administration. China Appl No. 201680057511.4. 3 pgs. Sep. 28, 2023.

* cited by examiner

LEVEL 3

LEVEL 2

LEVEL 1

MATTRESS FITTING METHOD:

- M3 / M5 / M7 CATEGORY (QUALITY / PRICE / VALUE) LEVELS OF SLEEP SURFACES WITH DIFFERENT ZONING AND MATERIALS, WHERE:
  - M = MATTRESS
  - 3 / 5 / 7 = NUMERICAL VALUES FOR DIFFERENT ASCENDING DEGREES OF PERFORMANCE MATERIALS, PERSONALIZED FIT, AND DURABILITY BASED ON BODY TYPE
- BASED ON YOUR BODY TYPE (SMALL / MEDIUM / LARGE BODY FRAME) AND SLEEP POSITION (STOMACH / BACK / SIDE / MULTIPLE), YOU ARE DIRECTED TO A SPECIFIC M SERIES TO MATCH YOUR SUPPORT NEEDS AND THEN YOU SELECT A PERSONALIZED LEVEL 0 – 3 COMFORT PREFERENCE

FIG. 17

DIFFERENT LEVELS OF BED PROVIDE DIFFERENT ZONING CHOICES, E.G.:

- M3: UNIVERSAL HEAD TO FOOT (MAY HAVE ADDITIONAL ZONING)
- M5: 3 ZONES FROM HEAD TO FOOT (MAY HAVE ADDITIONAL ZONING)
- M7: 5+ ZONES, OR MAY HAVE ADDITIONAL ZONING CUSTOM MOLDED TO YOUR BODY*

* AFTER SINKING INTO A "WATER BED"-LIKE STRUCTURE, 3D PRESSURE MAPPING WILL THEN OCCUR SO EVERY LOCATION ON THE BED IS ZONED TO YOUR SPECIFIC BODY CONTOURS, THIS IS SIMILAR TO RACING CAR SEATS, AND DENTAL MOLDING

FIG. 17A

EASY TO SHIP / EASY TO CARRY PACKAGING METHOD:

- 4 BOXES:
  - POWER PLANT 1 – INNER SPRING INNER CORE (DRIVER)
  - POWER PLANT 2 – INNER SPRING CORE (PASSENGER)
  - CHASSIS (1 FRAME)
    - NEW FOAM MATERIAL TBD
      - DUAL DUROMETER FOAM
      - INJECTION MOLDED LATEX
  - TOPPER (UPPER COVER, ATTACHES TO CHASSIS)

- MODULAR PIECES THAT ARE ASSEMBLED FOR YOU AT THE MOMENT OF DELIVERY BY RETAIL STORE DRIVER
- ONLY REQUIRES SINGLE DRIVER – DELIVERY PERSON
- CAN ALSO BE UPS DELIVERY TO HOMES, EVEN BY BIKE OR DRONE!

FIG. 26

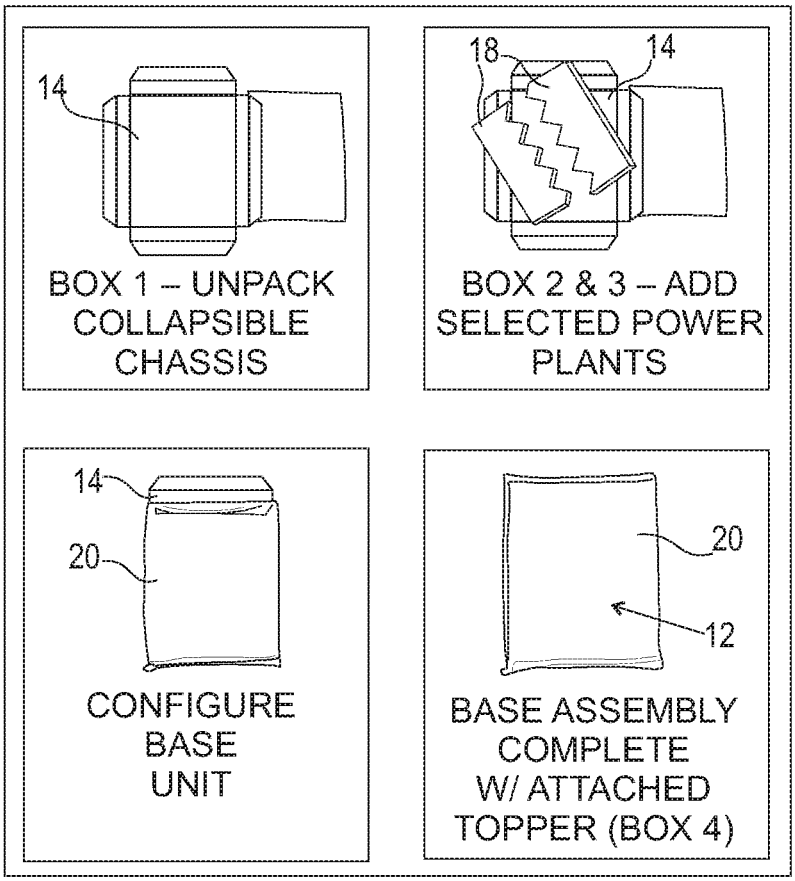

FIG. 27

REPLACE OR UPGRADE ANNUALLY W/ SUBSCRIPTION SALES:

- COLLECT CUSTOMER INFO
- REACH OUT ANNUALLY RE: MATTRESS BIRTHDAY & RENEWAL

CHASSIS CARRIES ONLY A 5 YEAR WARRANTY

TOPPER UNITS CARRY ONLY A 1 YEAR WARRANTY

CUSTOMIZABLE MATTRESS

CROSS-REFERENCE TO RELATED APPLICATIONS

This application is a division of U.S. patent application Ser. No. 15/220,964, filed on Jul. 27, 2016, which claims priority from Provisional Application 62/200,378 filed on Aug. 3, 2015 and is incorporated by reference herein, in its entirety.

TECHNICAL FIELD

The present disclosure generally relates to bedding, and more particularly to customizable mattresses that include variable components that allow a sleeper to create a mattress that has performance characteristics specifically tailored to the sleeper's body type and/or sleep preferences while also allowing the sleeper to replace the variable components with other variable components should the variable components become worn and/or the sleeper's body type or sleep preferences change over time.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Certain components of a mattress, such as, for example, springs and/or a mattress topper may become worn before other components of the mattress. It would thus be beneficial to provide a mattress that allows some components to be replaced without replacing the entire mattress. Indeed, replacing the springs of a mattress, for example, without replacing other components of the mattress would significantly reduce the cost to the user who would otherwise have to buy a new mattress if the springs become worn or otherwise in need of replacement.

Furthermore, sleeper's body type may change over time. For example, a sleeper may lose or gain weight. The change in weight may be slight or significant. When the change in weight is significant, it may affect the type of bedding the sleeper requires to achieve restful sleep. For example, a significant gain in weight may require that a sleeper use a firmer mattress, to provide support for the added weight. The sleeper's sleep preference may also change over time. For example, a sleeper who typically likes to sleep on their back may, over time, prefer to sleep on his or her side. The change in sleep preference may affect the type of bedding the sleeper requires to achieve restful sleep. For example, a sleeper changing from a back sleeper to a side sleeper may require that the sleeper use a firmer mattress.

Accordingly, this disclosure is directed to customizable mattresses that include variable components that allow a sleeper to create a mattress that has performance characteristics specifically tailored to the sleeper's body type and/or sleep preferences while also allowing the sleeper to replace the variable components with other variable components over time should the variable components become worn and/or the sleeper's body type or sleep preferences change over time.

SUMMARY

A customizable mattress is provided, in accordance with the principles of the present disclosure. The customizable mattress includes a chassis that defines a cavity. A spring pack is removably positioned within the cavity. A top pad removably covers at least a portion of the spring pack. In some embodiments, the customizable mattress includes an outer lower covering that surrounds at least a portion of the chassis. In some embodiments, the customizable mattress includes retention fabric that covers at least a portion of the top pad.

In some embodiments, the spring pack is divided into a first side configured to support a first sleeper and a second side configured to support a second sleeper, the first side being removably coupled to the second side. In some embodiments, the spring pack is divided into a first side configured to support a first sleeper and a second side configured to support a second sleeper, the first side interlocking with the second side such that the first side is removably coupled to the second side. In some embodiments, the spring pack is divided into a first side configured to support a first sleeper and a second side configured to support a second sleeper, the first side comprising a series of recesses, the second side comprising a series of projections disposed in the recesses to interlock the first side with the second side such that the first side is removably coupled to the second side. In some embodiments, the spring pack is divided into a first side configured to support a first sleeper and a second side configured to support a second sleeper, the first side being removably coupled to the second side, the first side having a different firmness than the second side. In some embodiments, the spring pack comprises a plurality of rows of springs, the springs in each row being connected to one another by a piece of material. In some embodiments, the material comprises at least one slit positioned between adjacent springs to prevent or limit movement of one of the adjacent springs when another one of the adjacent springs moves. In some embodiments, the material comprises welds positioned between adjacent springs to prevent or limit movement of one of the adjacent springs when another one of the adjacent springs moves.

In some embodiments, the chassis comprises a foam or formed plastic or similar material. In some embodiments, the chassis comprises a top portion, a bottom portion opposite the top portion and opposite side portions that extend between the top and bottom portions, the top and bottom portions each being removably coupled to the side portions. In some embodiments, the chassis comprises a top portion, a bottom portion opposite the top portion and opposite side portions that extend between the top and bottom portions, the side portions each including opposite first and second mortises, the top portion comprising tenons that fit into the first mortises to connect the top portion with the side portions, the bottom portion comprising tenons that fit into the second mortises to connect the top portion with the side portions. In some embodiments, the chassis comprises a top portion, a bottom portion opposite the top portion and opposite first and second side portions that extend between the top and bottom portions, the first side portion including opposite first and second mortises, the second side portion including opposite third and fourth mortises, the top portion including opposite fifth and sixth mortises, the bottom portion including opposite seventh and eighth mortises, the mattress further comprising a first corner piece comprising tenons that fit into the first and fifth mortises, a second corner pieces comprising tenons that fit into the second and seventh mortises, a third corner piece that fits into the third and sixth mortises and a fourth corner piece comprising tenons that fit into the fourth and eighth mortises to join the first and second side portions with the top and bottom portions.

In one embodiment, in accordance with the principles of the present disclosure, a kit is provided. The kit includes a customizable mattress having a chassis that defines a cavity. A spring pack is removably positioned within the cavity. A top pad removably covers at least a portion of the spring pack. In some embodiments, the customizable mattress includes an outer lower covering that surrounds at least a portion of the chassis. In some embodiments, the customizable mattress includes retention fabric that covers at least a portion of the top pad. In some embodiments, the spring pack comprises a plurality of spring packs each having a different firmness and the top pad comprises a plurality of top pads each having a different firmness. In some embodiments, the kit includes instructions for selecting one of the spring packs and one of the top pads based upon a sleeper's body type and/or sleep preference.

In one embodiment, in accordance with the principles of the present disclosure, a method is provided. The method includes the steps of: providing a kit that includes a customizable mattress having a chassis that defines a cavity, spring pack removably positioned within the cavity, a top pad removably covering at least a portion of the spring pack, an outer lower covering that surrounds at least a portion of the chassis and retention fabric that covers at least a portion of the top pad, wherein the spring pack comprises a plurality of spring packs each having a different firmness and the top pad comprises a plurality of top pads each having a different firmness; selecting one of the spring packs based upon a sleeper's first body type and/or sleep preference; selecting one of the top pads based upon the sleeper's first body type and/or sleep preference; positioning the selected spring pack in the cavity; and covering the selected spring pack with the selected top pad. In some embodiments, the method includes the steps of: removing the selected top pad from the selected spring pack; removing the selected spring pack from the cavity; selecting a second spring pad based upon an updated second body type and/or sleep preference; positioning the selected second spring pad within the cavity; selecting a second top pad based upon the updated second body type and/or sleep preference; and covering the selected second spring pack with the selected second top pad. In some embodiments, the selected second spring pack has a firmness that is different than that of the selected spring pack and the selected second top pad has a firmness that is different than that of the selected top pad. In some embodiments, the method includes the steps of: removing the selected top pad from the selected spring pack after the selected top pad becomes worn; removing the selected spring pack from the cavity after the selected spring pad becomes worn; selecting a second spring pad; positioning the selected second spring pad within the cavity; selecting a second top pad; and covering the selected second spring pack with the selected second top pad.

BRIEF DESCRIPTION OF THE DRAWINGS

The present disclosure will become more readily apparent from the specific description accompanied by the following drawings, in which:

FIG. 17 shows instructions for customizing the bedding system shown in FIG. 1;

FIG. 17A shows details concerning zoning choices for the bedding system shown in FIG. 1;

FIG. 17E-1 shows details concerning zoning choices for the bedding system shown in FIG. 1;

FIG. 17E-2 shows details concerning zoning choices for the bedding system shown in FIG. 1;

FIG. 26 shows details of a method used in connection with the bedding system shown in FIG. 1;

FIG. 27 shows details of a method used in connection with the bedding system shown in FIG. 1;

Like reference numerals indicate similar parts throughout the figures.

DETAILED DESCRIPTION

Figure 1:
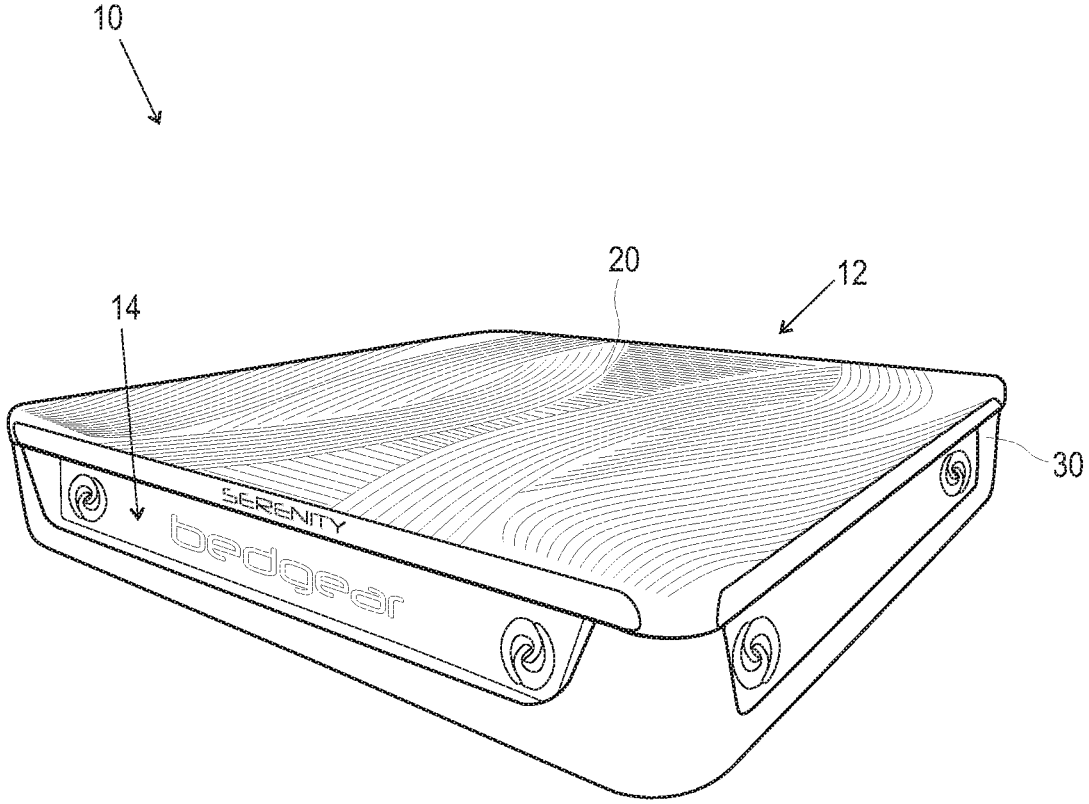
FIG. 1 is a perspective view of a bedding system in accordance with the present disclosure.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

The present disclosure is directed to customizable mattresses. In some embodiments, a mattress fitting method is provided for selecting components of a customizable mattress based upon body type and sleep position. In some embodiments, the mattress fitting method includes selecting a mattress category based on quality, price and/or value. In some embodiments, the mattress category is based upon the number of zones in the mattress. For example, one of the categories may include mattresses that have one zone such that the mattress is universal from head to foot; one of the categories may include mattresses that have three zones from head to foot; and one of the categories may include mattresses that have five or more zones or have additional zoning custom molded to a sleeper's body. In some embodiments, the additional zoning is determined by sinking the sleeper into a waterbed-like structure and using 3D mapping so that every location on the mattress is zoned to the sleeper's specific body contours, similar to racing car seats and dental molding. In some embodiments, the mattress categories are assigned numerical values for different ascending degrees of performance materials, personalized fit, and durability based on body type. In some embodiments, the numerical values of the mattress categories are 3, 5 and 7. In some embodiments, the mattress fitting method includes selecting the mattress category and selecting a level based upon body type and/or sleep position. In some embodiments, the levels are assigned numerical values for different body types and/or sleep positions. In some embodiments, the numerical values of the levels are 0, 1, 2 and 3. In some embodiments, the body types include small, medium and large body frames. In some embodiments, the body types include narrow, medium and broad body frames. In some embodiments, the sleep positions include stomach, back, side and multiple positions. In some embodiments, the multiple positions include any combination of stomach, back and side.

In some embodiments, the customizable mattress includes "driver vs. passenger" independent suspension choices that interlink and can be interchanged, to either side of the bed, as well as replaced over time. In some embodiments, the independent suspension is provided by springs or spring-like inner core support structures that stand and operate separately from each other via various methods of construction so the sleeper gets balanced support and flexibility with reduced motion transfer to other body areas and/or another sleeper. In some embodiments, the independent suspension includes a plurality of springs that each are positioned within spring pockets, the spring pockets being connected to one another by fabric. In some embodiments, the fabric is a flexible fabric that allows full individual movement that avoids dragging down adjoining springs. In some embodiments, the fabric includes sonic welds that define the spring pockets. A slit may be cut into the fabric between two rows of sonic welds to allow full individual movement that avoids dragging down adjoining springs. In some embodiments, the independent suspension includes a plurality of cradles each having a spring positioned therein to allow full individual movement that avoids dragging down other springs. In some embodiments, the springs snap into a cap and a base and include a cord between the cap and the base to give the spring a constant height. In some embodiments, the caps include a logo, such as, for example, a logo of the mattress manufacturer.

In some embodiments, an easy to ship and/or easy to carry packaging method is provided for transporting a customizable mattress. In some embodiments, the easy to ship and/or easy to carry packaging method includes packaging a modular customizable mattress in three or more boxes. In some embodiments, one box includes a first inner spring inner core of the customizable mattress. In some embodiments, one box includes a second inner spring inner core of the customizable mattress. In some embodiments, one box includes a frame or chassis of the customizable mattress. In some embodiments, one box includes a zippered topper or upper cover of the customizable mattress. In some embodiments, the chassis is made from a foam material, such as, for example, dual durometer foam or injection molded latex. In some embodiments, the easy to ship and/or easy to carry packaging method allows the modular pieces of the customizable mattress to be assembled at the moment of delivery by a retail store driver. In some embodiments, the easy to ship and/or easy to carry packaging method requires only a single driver, such as, for example, a delivery person, drone or UPS delivery to transport the modular pieces of the customizable mattress from a factory or warehouse to an end user.

In some embodiments, an easy to fit shopper and/or easy to return method is provided for purchasing and/or returning a customizable mattress. In some embodiments, the easy to fit shopper and/or easy to return method includes providing an SKU optimized for a retailer. In some embodiments, the easy to fit shopper and/or easy to return method includes providing the least amount of SKUs, while providing the most options. In some embodiments, the easy to fit shopper and/or easy to return method includes swapping independent suspension cores or power plants to alternate sides such that the independent suspension cores still interlink. In some embodiments, the easy to fit shopper and/or easy to return method includes reselecting a support level.

In some embodiments, a subscription sales method is provided for purchasing replacement components for a customizable mattress. In some embodiments, the subscription sales method includes collecting customer information. In some embodiments, the subscription sales method includes reaching out to customers periodically, such as, for example, annually. In some embodiments, the subscription sales method includes reaching out to customers based upon the date the customizable mattress was purchased (mattress birthday). In some embodiments, the subscription sales method includes renewing the subscription.

In some embodiments, the customizable mattress includes an adjustable chassis that allows for articulation of one portion of the chassis relative to other portions of the chassis. In some embodiments, the adjustable chassis is manual or electric. In some embodiments, the adjustable chassis includes motion devices embedded within the chassis. In some embodiments, the customizable mattress includes a self-enclosed powered adjustable chassis.

In some embodiments, the chassis includes "X" technology that provides features of an ambient to allow the chassis to circulate and generate airflow within one or more zones. In some embodiments, the "X" technology allows the chassis to circulate and generate airflow without having air blow on the sleeper. That is, the airflow is similar to that of a radiant floor to provide creature comfort. In some embodiments, the "X" technology allows the chassis to be as efficient in heating and/or cooling the environment surrounding the customizable mattress for the sleeper's comfort as well as the system itself. In some embodiments, topper pads have a material surface texture for comfort and pressure sensitivity. In some embodiments, the customizable mattress includes various topper attachment concepts that allow for easy replacement and/or reselection of the comfort layer. In some embodiments, the topper attachment concepts include carabineer style connections. In some embodiments, the topper attachment concepts include stretched straps that connect the topper pad to a lower mattress. In some embodiments, the lower mattress is made from woven tent material. In some embodiments, the topper attachment concepts include hot rod strap style connections. In some embodiments, the topper attachment concepts include leather straps that connect the topper pad to a lower mattress.

In some embodiments, the customizable mattress includes a chassis that defines a cavity, two spring packs removably positioned within the cavity and a top pad that removably covers at least a portion of the spring pack. The spring packs and the top pad may have variable components. That is, different versions of the spring packs and the top pad are available to allow a sleeper to customize the mattress to suit his or her preferred sleep position and/or body type. In some embodiments, three versions of the spring packs are available and include a soft spring pack, a medium spring pack and a firm spring pack. In that each mattress includes two spring packs, this allows for six combinations: soft/soft, medium/medium, firm/firm, soft/medium, soft/firm and medium/firm. Furthermore, left/right reversals of the spring packs double the number of combinations. In some embodiments, the two spring packs of a given mattress interlock to allow a blend of firmness at the center. In some embodiments, the spring packs interlock using a one row, one spring blend. In some embodiments, the spring packs interlock using a two row, one spring blend. In some embodiments, the spring packs interlock using a one row, two spring blend. In some embodiments, three versions of the top pads are available and include a soft top pad, a medium top pad and a firm top pad. In some embodiments, the top pads include stitching that forms a pattern in the top pads. For example, in one embodiment, the top pads include a pattern that resembles a flame.

In some embodiments, the chassis is made from molded foam, carbon fiber or fiberglass or other thermo-molded plastic-like material foundation that shapes the interior or the exterior. In some embodiments, sculpting the exterior gives the mattress a unique appearance. In some embodiments, the chassis is made up of a plurality of separate pieces and the customizable mattress includes an outer lower cover that surrounds at least a portion of the chassis to hold the separate pieces together. The chassis may be rolled for delivery, with the outer lower cover coupled to the chassis. After delivery, the chassis is unrolled, with the outer lower cover coupled to the chassis. Any of the separate pieces that are not connected to the chassis are then connected to the chassis. Selected spring packs are positioned within a cavity of the chassis. A top pad is then positioned over the spring packs.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a customizable mattress in accordance with the principles of the present disclosure. Alternate embodiments are also disclosed. Reference will now be made in detail to the exemplary embodiments of the present disclosure, which are illustrated in the accompanying figures. Turning to FIGS. 1-29, there are illustrated components of a bedding system 10.

Figure 2A:
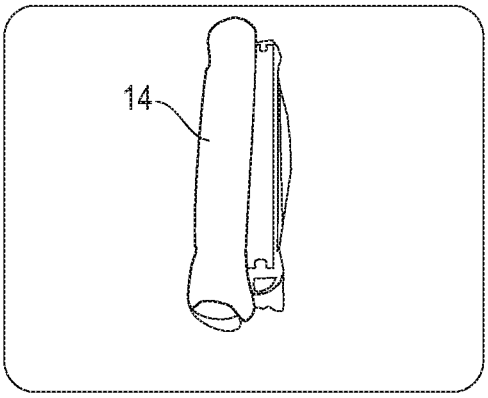
FIG. 2A shows the assembly of a component of the bedding system shown in FIG. 1.
Figure 2B:
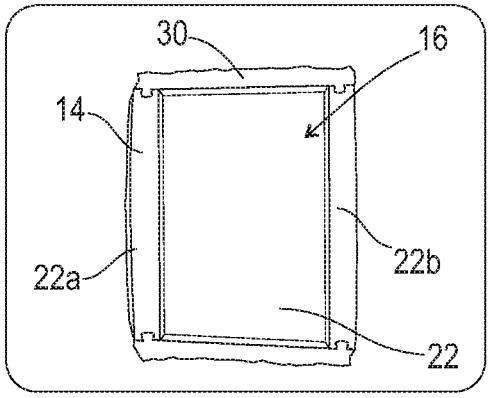
FIG. 2B shows the assembly of a component of the bedding system shown in FIG. 1.
Figure 2C:
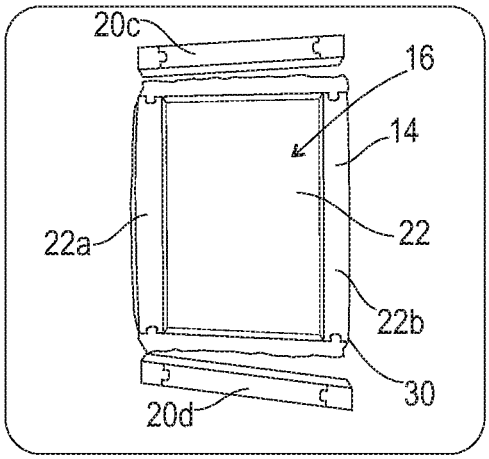
FIG. 2C shows the assembly of a component of the bedding system shown in FIG. 1.
Figure 2D:
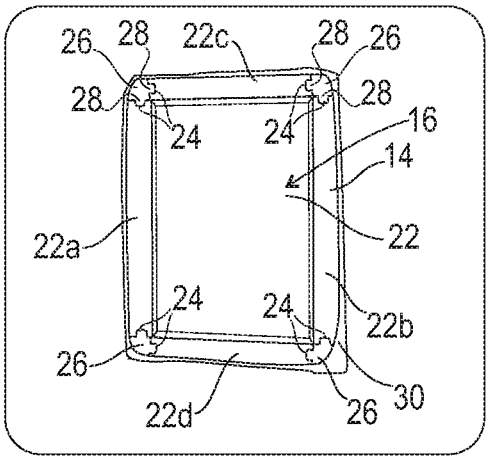
FIG. 2D shows the assembly of a component of the bedding system shown in FIG. 1.
Figure 2E:
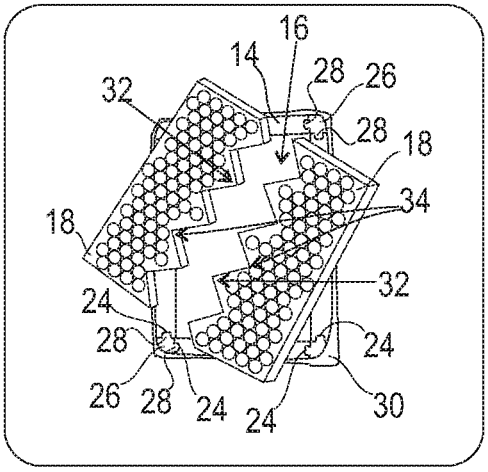
FIG. 2E shows the assembly of a component of the bedding system shown in FIG. 1.
Figure 2F:
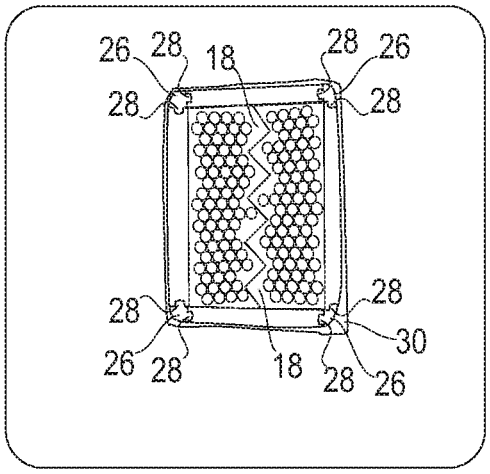
FIG. 2F shows the assembly of a component of the bedding system shown in FIG. 1.

System 10 includes a mattress 12. Mattress 12 is configured to be customizable to create a mattress that has performance characteristics specifically tailored to the sleeper's body type and/or sleep preferences while also allowing the sleeper to replace components with other components should the components become worn and/or the sleeper's body type or sleep preferences change over time. Mattress 12 includes a chassis 14 having an inner surface that defines a cavity 16, as shown in FIG. 2B. A pair of spring packs 18 are removably positioned within cavity 16, as shown in FIGS. 2E and 2F. A top pad 20 removably covers at least a portion of spring pack 18.

Figure 3:
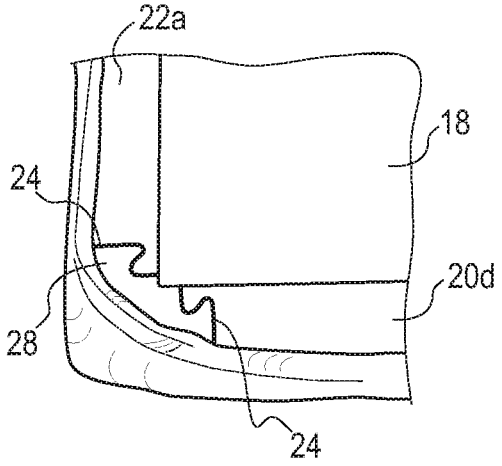
FIG. 3 is a top view of components of the bedding system shown in FIG. 1.
Figure 3A:
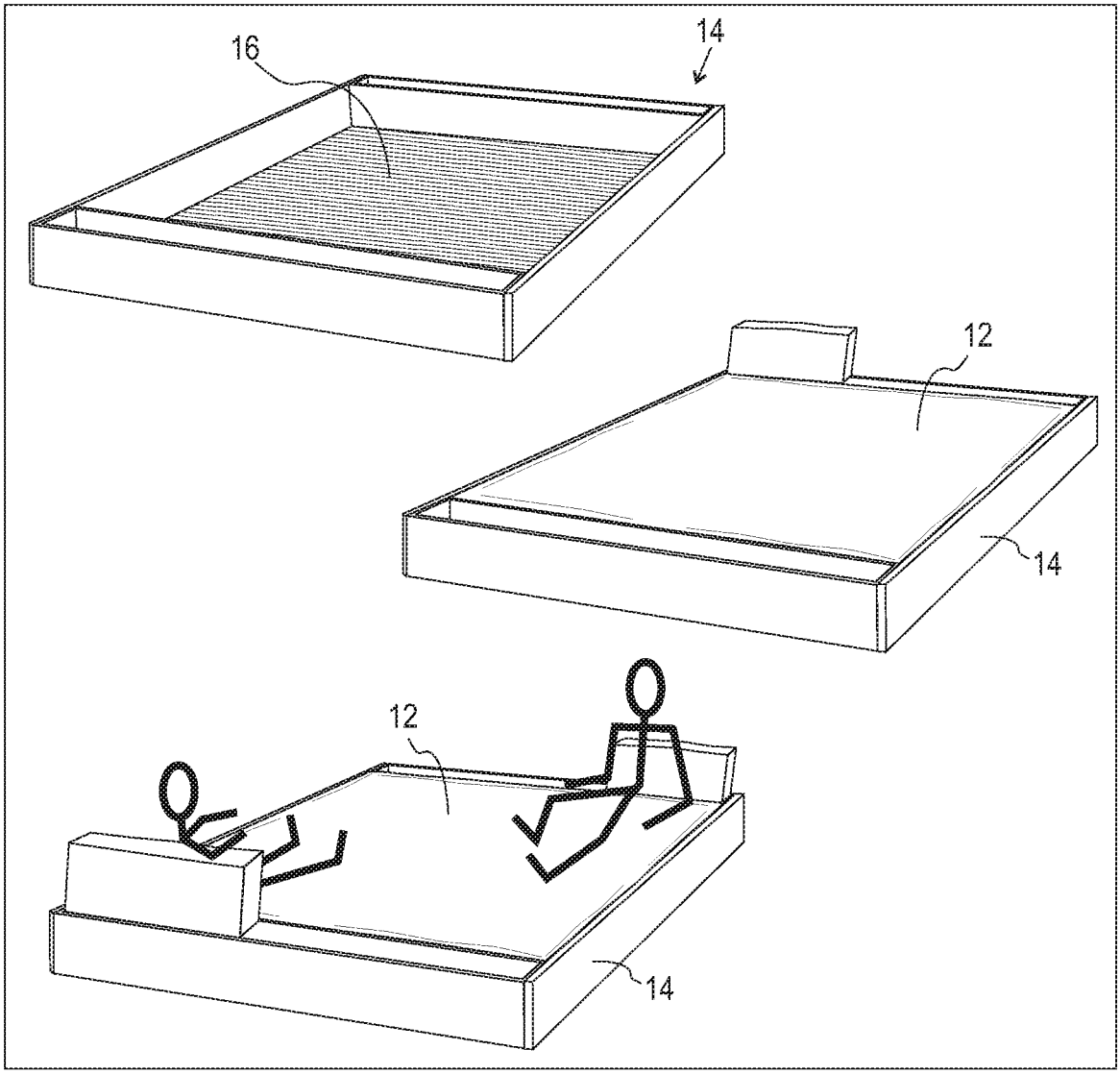
FIG. 3A is a perspective view of one embodiment of a component of the bedding system shown in FIG. 1.

In some embodiments, shown in FIGS. 2A-2F and 3, chassis 14 includes a base 22, opposite first and second side portions 22*a*, 22*b* that extend upwardly from base 22, a top portion 22*c* and a bottom portion 22*d* opposite top portion 20*c*, top and bottom portions 20*c*, 20*d* each extending between first and second side portions 22*a*, 22*b*. In some embodiments, first and second side portions 22*a*, 22*b* are fixed to base 22 and top and bottom portions 20*c*, 20*d* are removably connected to first and second side portions 22*a*, 22*b* and base 22. First side portion 22*a* includes opposite first and second mortises 24, second side portion 22*b* includes opposite third and fourth mortises 24, top portion includes opposite fifth and sixth mortises 24 and bottom portion 22*d* includes opposite seventh and eighth mortises 24. Chassis 14 includes a first corner piece 26 comprising tenons 28 that fit into first and fifth mortises 24, a second corner piece 26 comprising tenons 28 that fit into second and seventh mortises 24, a third corner piece 26 that fits into third and sixth mortises 24 and a fourth corner piece 26 comprising tenons 28 that fit into the fourth and eighth mortises 24 to join first and second side portions 22*a*, 22*b* with top and bottom portions 22*c*, 22*d*. A planar surface of base 22 and inner surfaces of first and second side portions 22*a*, 22*b*, top portion 22*c* and bottom portion 22*d* define the inner surface of chassis 14 that defines cavity 16. One particular embodiment of chassis 14 is shown in FIG. 3A.

Figure 3B:
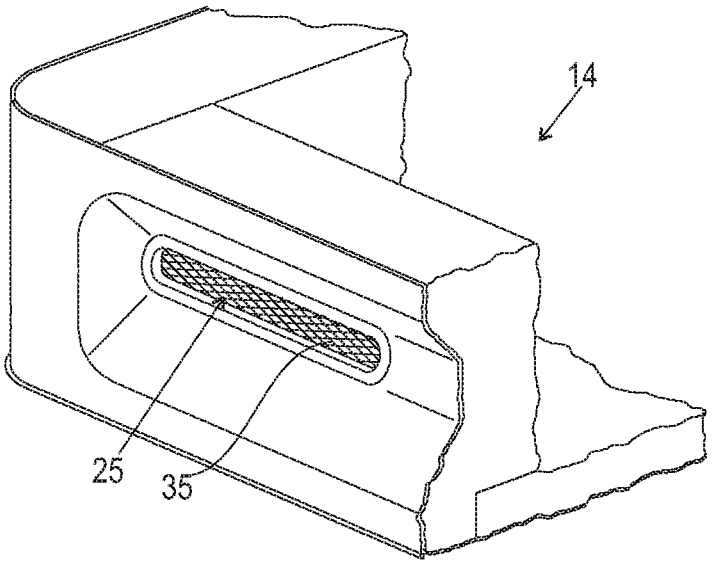
FIG. 3B is a perspective, breakaway view of one embodiment of a component of the bedding system shown in FIG. 1.

In one embodiment, shown in FIG. 3B, chassis 14 includes at least one opening that defines a vent 25 extending through opposite inner and outer surfaces of chassis 14. Vents 25 are configured to allow air flow in and out of cavity 16. That is, vents 25 allow air to circulate and exchange from an inner core of mattress 12 to a room environment. In one embodiment, vent 25 is molded into sides of chassis 14, such as, for example, at least one of side portions 22*a*, 22*b*. Each vent 25 includes a mesh material 35 positioned therein. Mesh material 35 acts as a filter to trap particulate matter as air flows in and out of cavity 16. In some embodiments, at least one of base 22, first and second side portions 22*a*, 22*b* and top portion 22*c* includes one or more vents 25. In some embodiments, at least one of vents 25 is positioned within a recessed cavity of chassis 14.

In some embodiments, mattress 12 comprises an outer lower covering 30 that surrounds or encloses at least a portion of chassis 14, as shown in FIGS. 2A-2F and 3. In some embodiments, outer lower covering 30 covers an entire bottom surface of base 22, entire outer surfaces of first and second side portions 22*a*, 22*b*, entire outer surfaces of top and bottom portions 22*c*, 22*d*, at least a portion of top surfaces of first and second side portions 22*a*, 22*b* and at least a portion of top surfaces of top and bottom portions 22*c*, 22*d*. In some embodiments, outer lower cover 30 may be configured to entirely cover the top surfaces of first and second side portions 22*a*, 22*b* and/or the top surfaces of top and bottom portions 22*c*, 22*d*. In some embodiments, outer lower cover 30 may be configured to entirely cover corner pieces 26. In some embodiments, outer lower cover 30 includes curved corners that each cover at least a portion of one of corner pieces 26. In some embodiments, outer lower covering 30 includes a mesh material.

In some embodiments, chassis 14 may be rolled for delivery, with outer lower cover 30 coupled to chassis 14. In some embodiments, top and bottom portions 22*c*, 22*d* have been removed from chassis 14 prior to rolling chassis 14. After delivery, chassis 14 is unrolled; with outer lower cover 30 coupled to chassis 14. Tenons 28 of corner pieces 26 are positioned in mortises 24 of first and second side portions 22*a*, 22*b* and top and bottom portions 22*c*, 22*d* in the manner discussed above. Either before or after spring packs 18 are positioned within cavity 16, outer lower cover 30 may be moved relative to top and bottom portions 22*c*, 22*d* such that outer lower cover 30 covers at least a portion of top and bottom portions 22*c*, 22*d*.

Figure 4A:
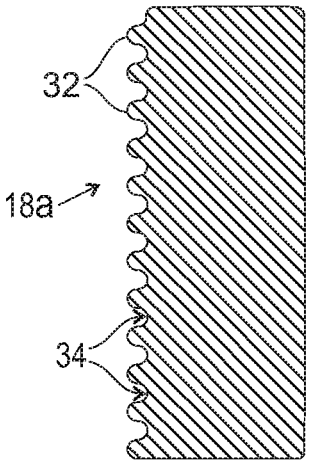
FIG. 4A is a top view of a component of the bedding system shown in FIG. 1.
Figure 4B:
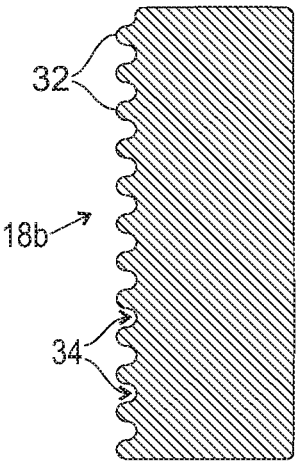
FIG. 4B is a top view of a component of the bedding system shown in FIG. 1.
Figure 4C:
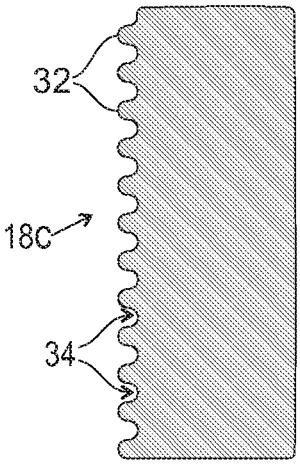
FIG. 4C is a top view of a component of the bedding system shown in FIG. 1.

In some embodiments, spring packs 18 include a first spring pack 18*a*, a second spring pack 18*b* and a third spring pack 18*c*, as shown in FIGS. 4A-4C. Spring packs 18*a*, 18*b*, 18*c* are identical in terms of size and shape, but differ with regard to firmness. For example, spring pack 18*b* may be firmer than spring pack 18*a* and spring pack 18*c* may be firmer than spring pack 18*b*. In some embodiments, system 10 may include one or a plurality of additional spring packs each having a firmness that is different than that of spring packs 18*a*, 18*b*, and 18*c*. In that mattress 12 includes two spring packs 18, providing spring packs 18*a*, 18*b*, and 18*c* with different firmnesses that allows for six combinations: soft/soft, medium/medium, firm/firm, soft/medium, soft/ firm and medium/firm. In some embodiments, spring packs 18*a*, 18*b*, 18*c* are formed from the same material. In some embodiments, spring packs 18*a*, 18*b*, 18*c* are formed from different materials.

Figure 5A:
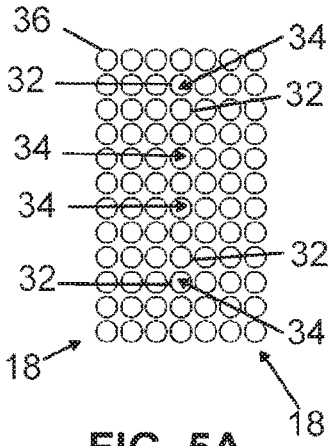
FIG. 5A is a top view of one embodiment of a component of the bedding system shown in FIG. 1.
Figure 5B:
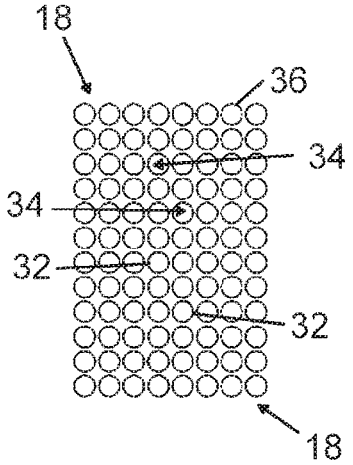
FIG. 5B is a top view of one embodiment of a component of the bedding system shown in FIG. 1.
Figure 5C:
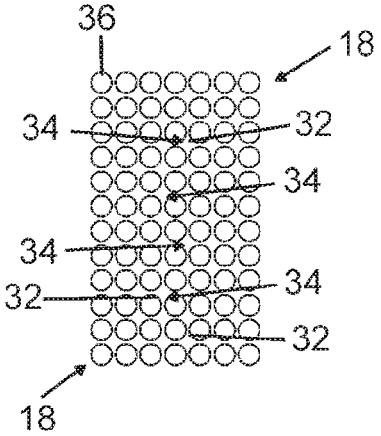
FIG. 5C is a top view of one embodiment of a component of the bedding system shown in FIG. 1.
Figure 6A:
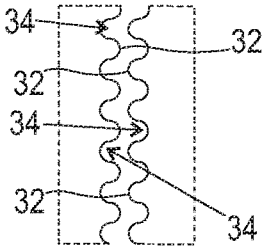
FIG. 6A is a top view of one embodiment of a component of the bedding system shown in FIG. 1.

In some embodiments, spring packs 18 each include projections 32 that are configured to be positioned within recesses 34 of another one of spring packs 18, such as, for example, one of spring packs 18*a*, 18*b*, 18*c*. Spring packs 18 each include a plurality of springs 36, as shown in FIGS. 5A-5C. In one embodiment, shown in FIGS. 5A and 6A, projections 32 of spring packs 18 are each made up of one spring 36 and recesses 34 span the cross sectional distance or width of one spring 36 such that spring packs 18 have a one row one spring blend, as shown in FIGS. 5A and 6A.

Figure 6B:
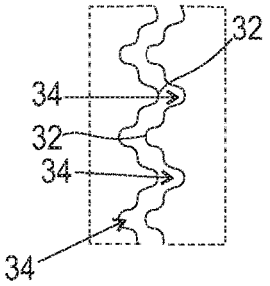
FIG. 6B is a top view of one embodiment of a component of the bedding system shown in FIG. 1.

In one embodiment, shown in FIGS. 5B and 6B, projections 32 of spring packs 18 are each made up of four springs 36 that are arranged to have a pyramidal or triangular configuration. That is, a tip of each projection 32 spans the cross sectional distance or width of one spring 36 and a base of each projection 32 that the tip extends from spans the cross sectional distance or width of three springs 36. Recesses 34 each have a narrowed first end portion that receives the tip of one of projections 32. The first end portion of recess 34 spans the cross sectional distance or width of one spring 36. Recesses 34 also include an enlarged second end portion that spans the cross sectional distance or width of three springs 36. The enlarged second end portion of recess 34 receives the base of one of projections 34 such that spring packs 18 have a two row one spring blend, as shown in FIGS. 5B and 6B.

Figure 6C:
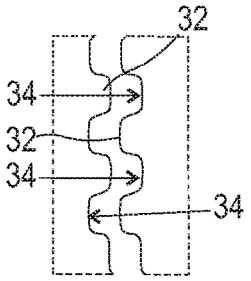
FIG. 6C is a top view of one embodiment of a component of the bedding system shown in FIG. 1.

In one embodiment, shown in FIGS. 5C and 6C, projections 32 of spring packs 18 are each made up of two springs 36 and recesses 34 span the cross sectional distance or width of two springs 36 such that spring packs 18 have a one row two spring blend, as shown in FIGS. 5C and 6C.

Figure 7:
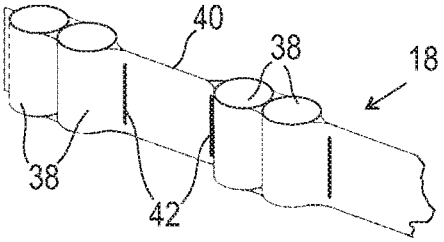
FIG. 7 is a perspective, breakaway view of a component of the bedding system shown in FIG. 1.
Figure 8A:
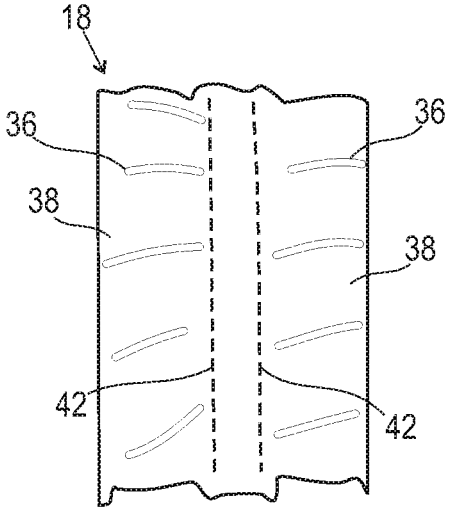
FIG. 8A is a side view of one embodiment of a component of the bedding system shown in FIG. 1.
Figure 8B:
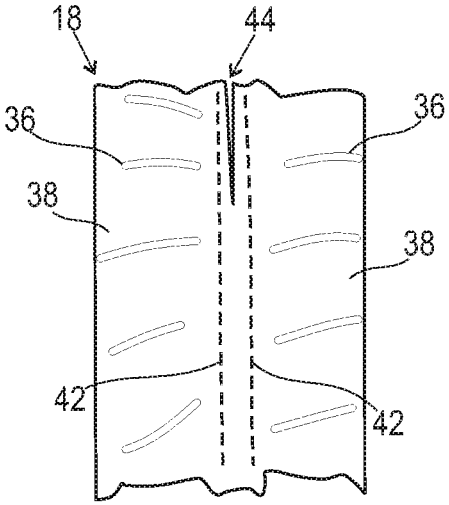
FIG. 8B is a side view of one embodiment of a component of the bedding system shown in FIG. 1.
Figure 8C:
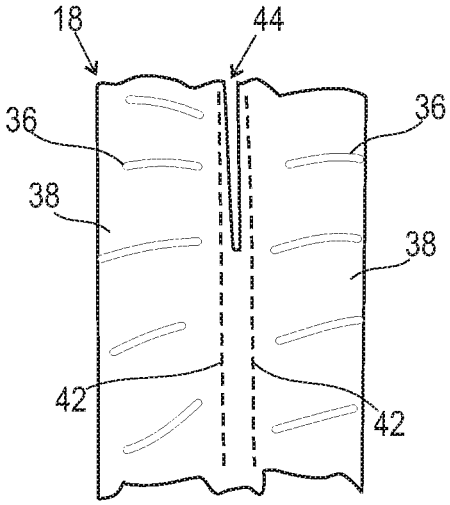
FIG. 8C is a side view of one embodiment of a component of the bedding system shown in FIG. 1.
Figure 9:
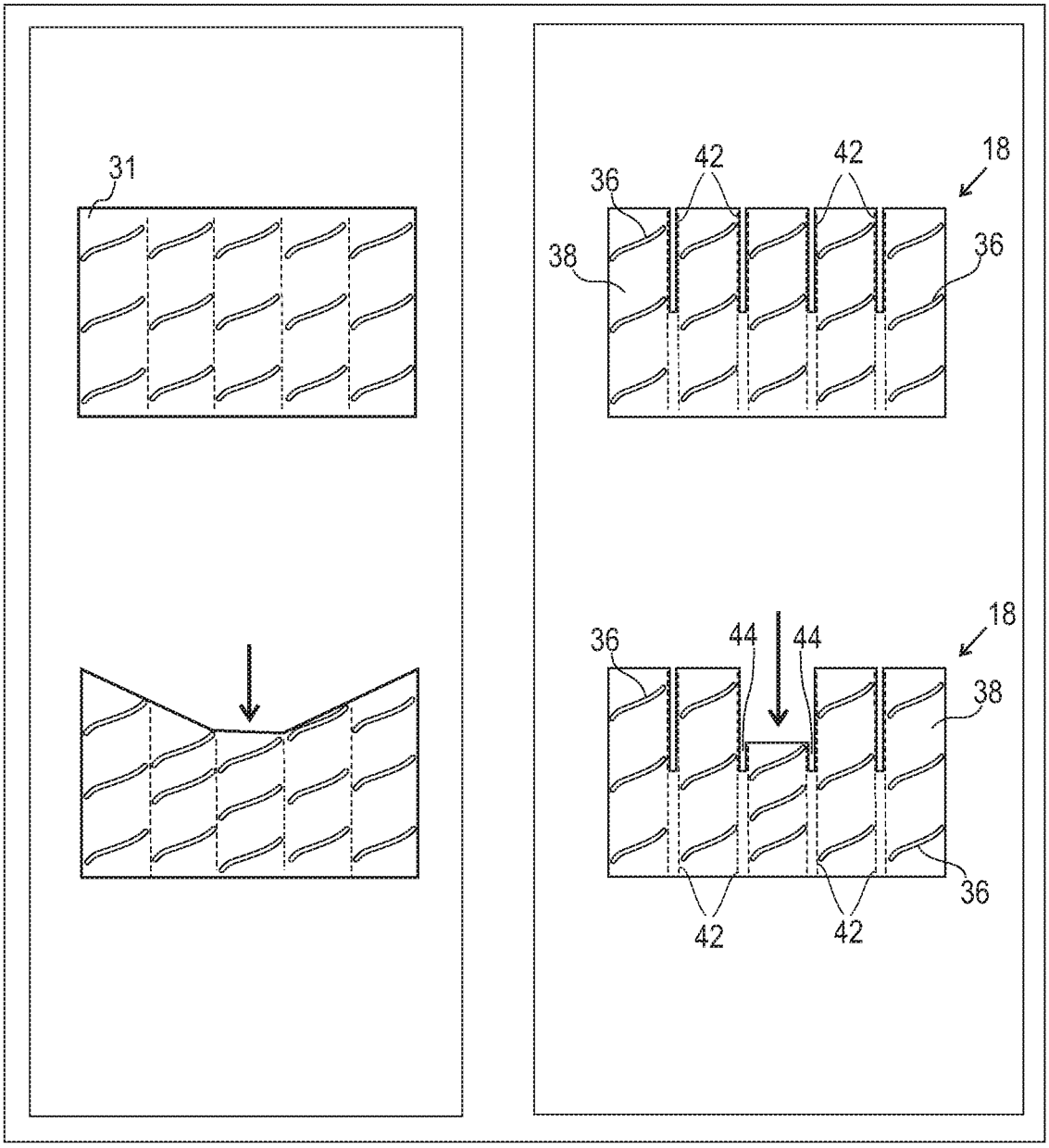
FIG. 9 shows a comparison between a component of the bedding system shown in FIG. 1 and prior art components.

In some embodiments, shown in FIGS. 7-9, springs 36 are positioned in spring pockets 38. Spring pockets 38 comprise a fabric that each enclose one of springs 36. Adjacent spring pockets 38 are joined to one another by a material 40. In some embodiments, material 40 is the same material as the fabric that makes up spring pockets 38. In some embodiments, material 40 is a different material than the fabric that makes up spring pockets 38. In some embodiments, spring pockets 38 include welds, such as, for example, sonic welds 42 that provide strength to spring pockets 38. In some embodiments, welds 42 are double weld rows, as shown in FIG. 9.

In one embodiment, shown in FIG. 8A, material 40 is free of any slits or vertical cuts. In some embodiments, shown in FIGS. 7 and 8B-9, material 40 includes a slit 44 between adjacent welds 42. In some embodiments, slits 44 are positioned between double welds 42, as shown in FIG. 9. Slits 44 allow a spring 36 in a spring pocket 38 to be compressed without compressing springs 36 in adjacent spring pockets 38, as shown in FIG. 9. That is, without slits 44, compressing a spring 36 in a spring pocket 38 will also compress springs 36 in adjacent spring pockets 38, as also shown in FIG. 9. FIG. 9 also shows a comparison between components of the bedding system 10 and prior art components 31. In one embodiment, shown in FIG. 8B, slits 44 are made by making a short cut into material 40. In this embodiment, slits 44 are between 0-⅓ the height of material 40, wherein the height of material 40 is defined by the height of springs 36 when springs are not compressed. In one embodiment, shown in FIG. 8C, slits 44 are made by making a longer cut into material 40. In this embodiment, slits 44 are between ⅓-½ the height of material 40, wherein the height of material 40 is defined by the height of springs 36 when springs 36 are not compressed. In some embodiments, slits 44 are between ½-¾ the height of material 40, wherein the height of material 40 is defined by the height of springs 36 when springs 36 are not compressed.

Figure 10:
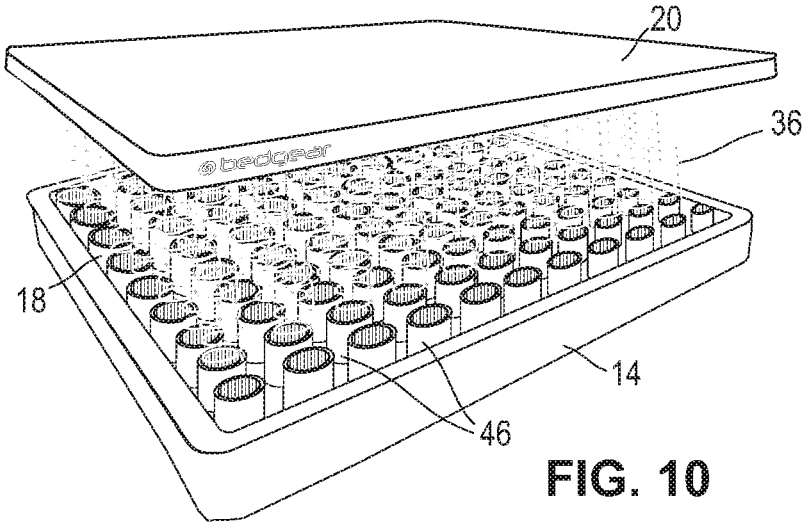
FIG. 10 is a perspective view of one embodiment of components of the bedding system shown in FIG. 1, with parts separated.

In one embodiment, shown in FIG. 10, chassis 14 includes a plurality of cradles 46 that each house one of springs 36. Cradles 46 are fixed to chassis 14. Cradles 46 each have a cylindrical configuration with an open top that allows springs 36 to be positioned therein. In some embodiments, cradles 46 each have a height that is less than that of springs 36 when springs 36 are not compressed such that top portions of springs 36 will extend out of cradles 46 when springs 36 are not compressed. In some embodiments, cradles 46 each have a height that is equal to that of springs 36 when springs 36 are compressed such that top portions of springs 36 will be flush with top portions of cradles 46 when springs 36 are compressed. That is, cradles 46 will fully surround springs 36 when springs 36 are compressed. In some embodiments, cradles 46 each have a height that is less than that of springs 36 when springs 36 are compressed such that top portions of springs 36 will extend out of cradles when springs 36 are compressed. Cradles 46 are spaced apart from one another such that when one spring 36 is compressed, cradles 46 prevent adjacent springs 36 from compressing. That is, cradles 46 allow springs 36 to stand and operate separately from other springs 36.

Figure 10A:
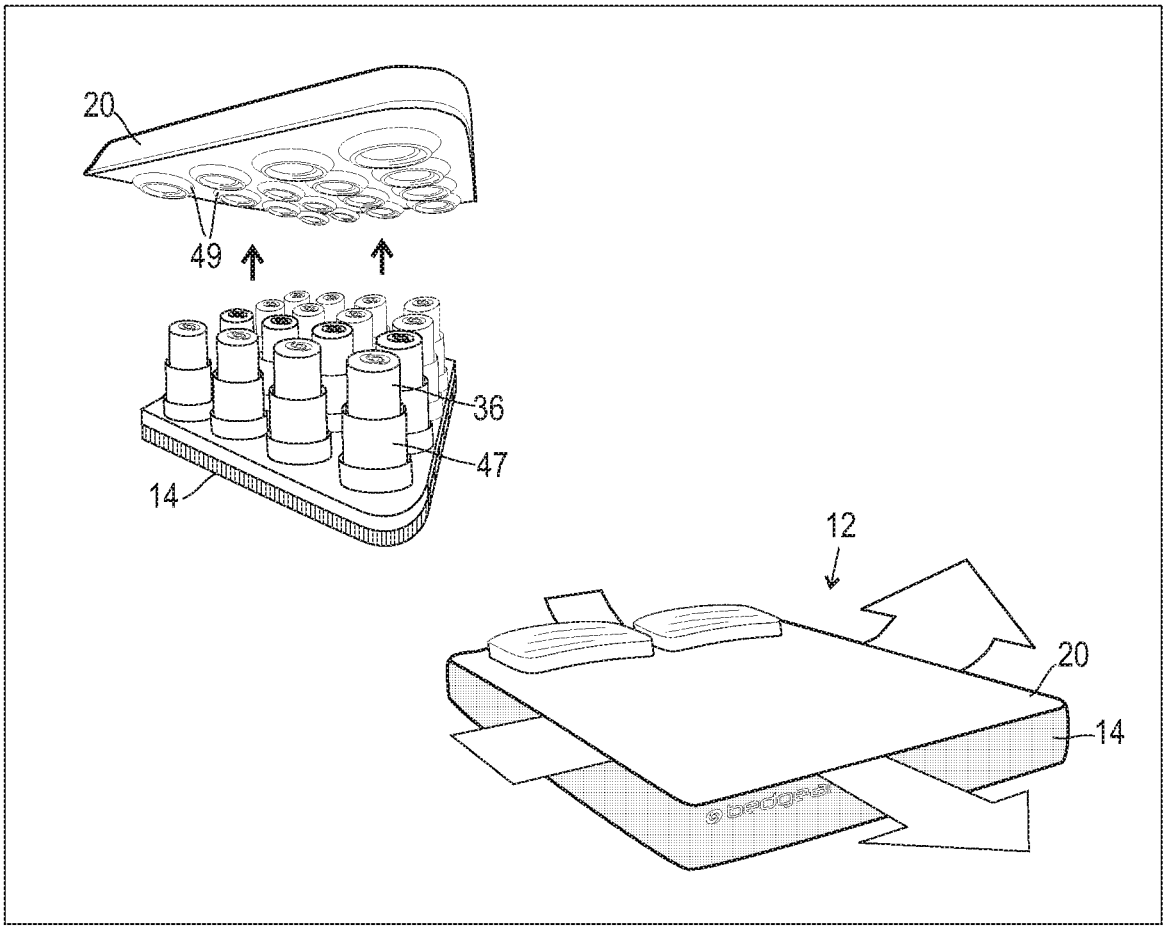
FIG. 10A is a perspective view of one embodiment of components of the bedding system shown in FIG. 1.

In one embodiment, shown in FIG. 10A, chassis 14 includes a plurality of cradles 47 that each house a lower portion of one of springs 36. Cradles 47 are fixed relative to chassis 14. In some embodiments, cradles 47 are formed from a silicon membrane. Cradles 47 each have a cylindrical configuration with an open top that allows the lower portions of springs 36 to be positioned therein. In some embodiments, cradles 47 each have a height that is less than that of springs 36 when springs 36 are not compressed such that top portions of springs 36 will extend out of cradles 46 when springs 36 are not compressed. Top pad 20 includes a plurality of spring cups 49 each configured to receive a top portion of one of springs 36. Spring cups 49 are fixed relative to top pad 20. Each of spring cups 49 is coaxial with one of cradles 47 such that when springs 36 are positioned within cradles 47 and spring cups 49, an interlocking upper and lower mattress is created that does not need the support of side foam. This allows for the use of a mesh and/or breathable material to be used in place of side foam. As such, in this embodiment, chassis 14 may include a perforate side mesh to allow mattress 12 to breath, unlike traditional side foam.

Figure 11A:
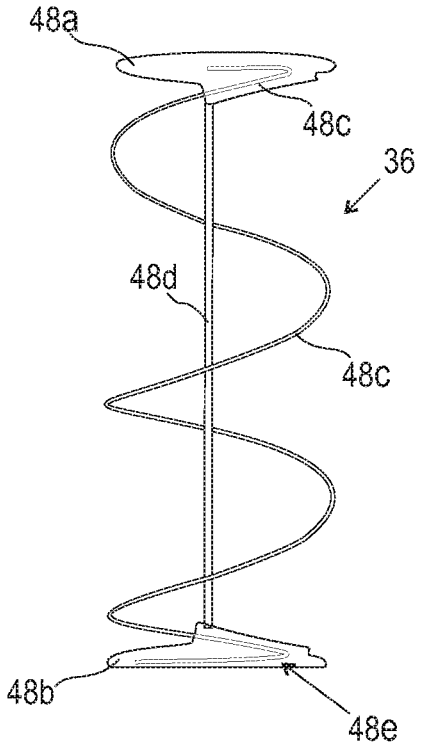
FIG. 11A is a side view of a component of the bedding system shown in FIG. 1.
Figure 11B:
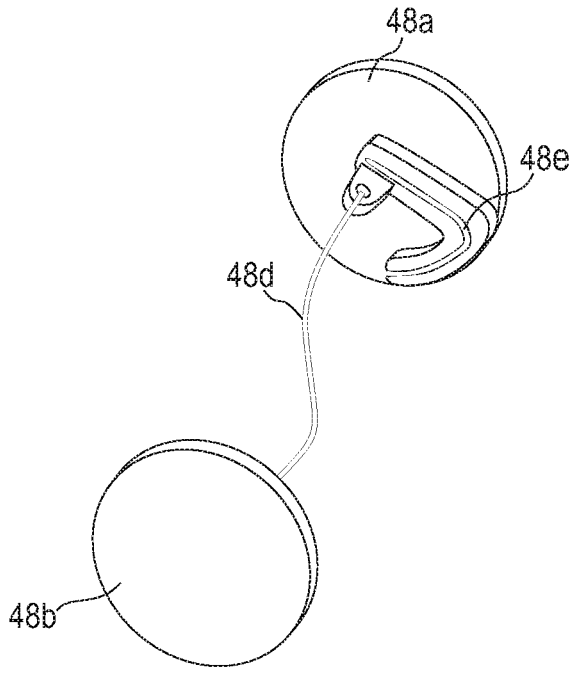
FIG. 11B is a perspective view of a component of the bedding system shown in FIG. 1.
Figure 11C:
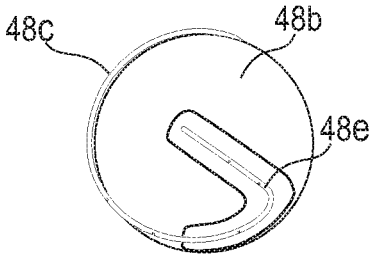
FIG. 11C is a top view of a component of the bedding system shown in FIG. 1.
Figure 11D:
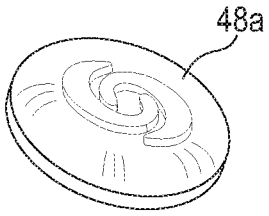
FIG. 11D is a perspective view of a component of the bedding system shown in FIG. 1.

In one embodiment, shown in FIGS. 11A-11D, springs 36 each include a cap 48*a*, a base 48*b*, a coiled element 48*c* and a cord 48*d*. Cord 48 extends between cap 48*a* and base 48*b* such that cap 48*a* and base 48*b* each extend perpendicular to cord 48*d*. In some embodiments, cord 48*d* includes at least one bend, as shown in FIG. 11B. Cord 48*d* is configured to provide spring 36 with a constant height. That is, cord 48*d* ensures that spring 36 cannot be compressed to have a height that is less than that of cord 48*d*. A first end of coiled element 48*c* is fixed to cap 48*a* and an opposite second end of coiled element 48*c* is fixed to base 48*b*. In some embodiments, cap 48*a* and base 48*b* each include an arcuate cavity 48*e* configured to receive one of the first and second ends of coiled element 48*c*, as shown in FIGS. 11A and 11B. In some embodiments, the first and second ends of coiled element 48*c* are configured to snap into cavities 48*e*. In some embodiments, cap 48*a* includes a logo, such as, for example, the logo of the manufacturer of mattress 12 that faces away from base 48*b*.

Figure 12:
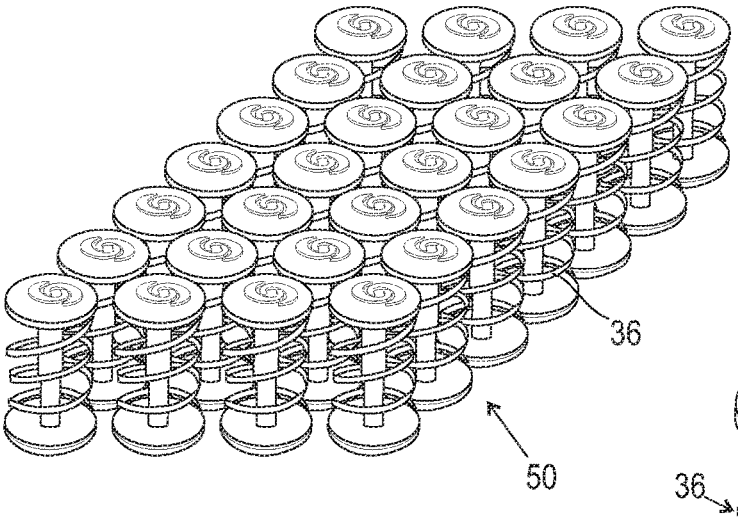
FIG. 12 is a perspective view of components of the bedding system shown in FIG. 1.
Figure 12A:
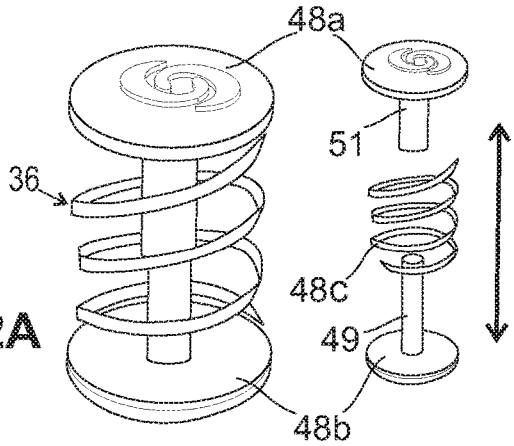
FIG. 12A is a perspective view of one embodiment of components of the bedding system shown in FIG. 1.

In one embodiment, shown in FIG. 12, spring packs 18 have an egg carton-like configuration that includes a plurality of spaced apart cavities 50 each having a bottom portion of one of springs 36 positioned therein. Spacing cavities 50 apart from one another also spaces springs 36 apart from one another. In this embodiment, spring packs 18 do not include any sleeves or spring pockets, such as, for example, spring pockets 38. This allows better airflow between adjacent springs 36. In the embodiment shown in FIG. 12A, base 48*b* includes a dowel 49 and cap 48*a* includes a sleeve 51 having a passageway configured to receive dowel 49 therein. Dowel 49 is movable within sleeve 51 such that cap 48*a* moves toward base 48*b* as coiled element 48*e* compresses and cap 48*a* moves away from base 48*b* as coiled element 48*e* decompresses or expands. In this embodiment, spring 36 comprises a plastic or rubberized material to hold spring 36 in tension to control firmness.

Figure 12B:
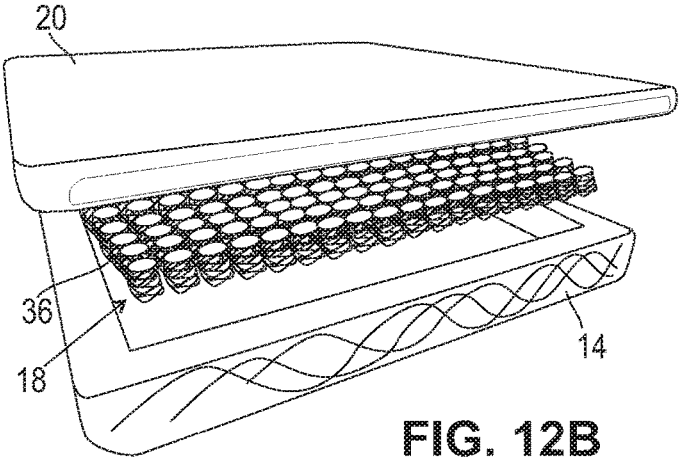
FIG. 12B is a side view of one embodiment of components of the bedding system shown in FIG. 1.
Figure 12C:
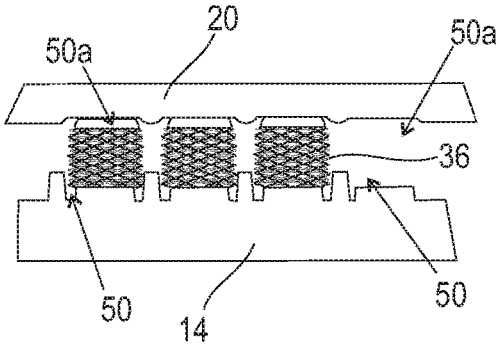
FIG. 12C is a perspective view of one embodiment of a component of the bedding system shown in FIG. 1.
Figure 12D:
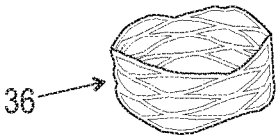
FIG. 12D is a perspective view of a component of the bedding system shown in FIG. 1.

In one embodiment, shown in FIGS. 12B-12D, top pad 20 may include cavities 50*a* configured to receive top portions of springs 36. Positioning springs 36 within cavities 50, 50*a* secures springs 36 between chassis 14 and top pad 20. As shown in FIG. 12D, spring 36 may be formed from a plurality of layers each having an undulating configuration. In particular, concave portions of a first undulating layer are in direct contact with convex portions of a second undulating layer and convex portions of the first undulating layer are in direct contact with concave portions of a third undulating layer, the first undulating layer being positioned between the second and third undulating layers. In some embodiments, spring 36 is formed from a single strip of material that is coiled to form the undulating layers.

Figure 13A:
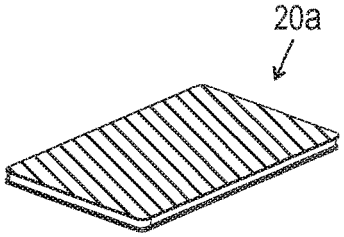
FIG. 13A is a perspective view of one embodiment of a component of the bedding system shown in FIG. 1.
Figure 13B:
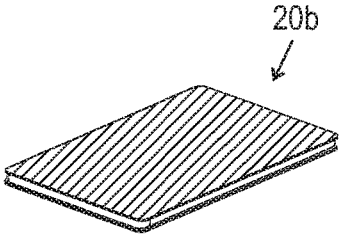
FIG. 13B is a perspective view of one embodiment of a component of the bedding system shown in FIG. 1.
Figure 13C:
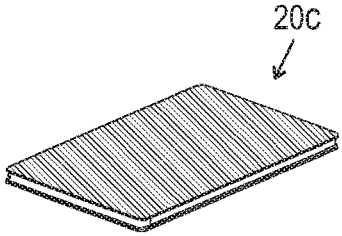
FIG. 13C is a perspective view of one embodiment of a component of the bedding system shown in FIG. 1.
Figure 17B:
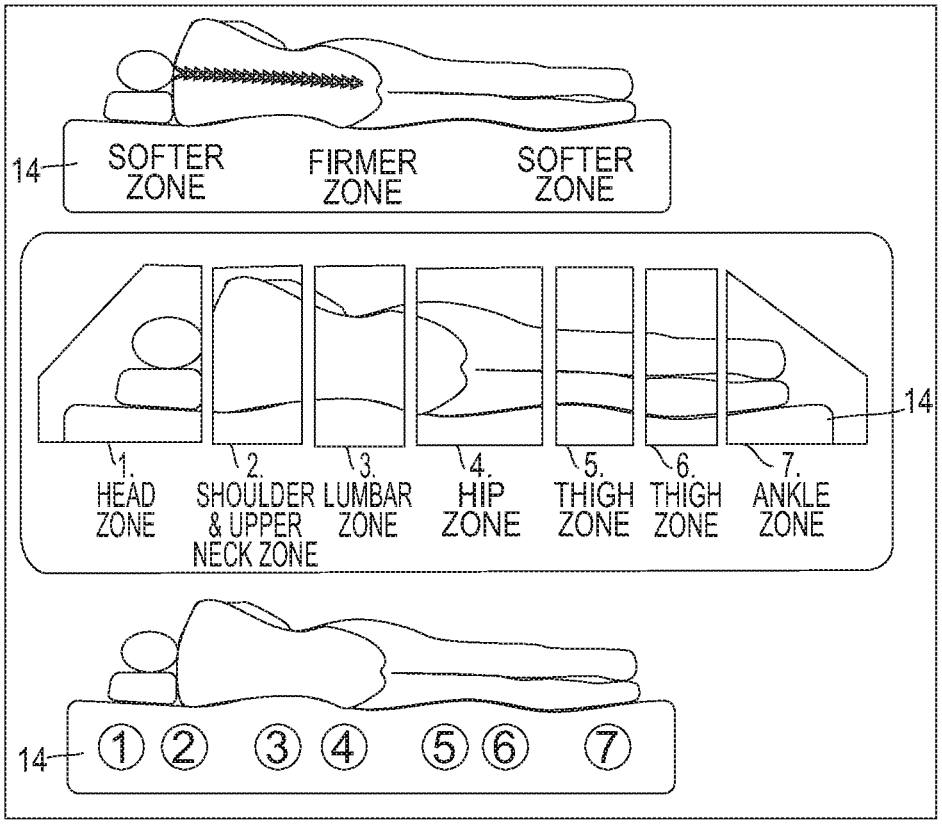
FIG. 17B shows details concerning zoning choices for the bedding system shown in FIG. 1.
Figure 17C:
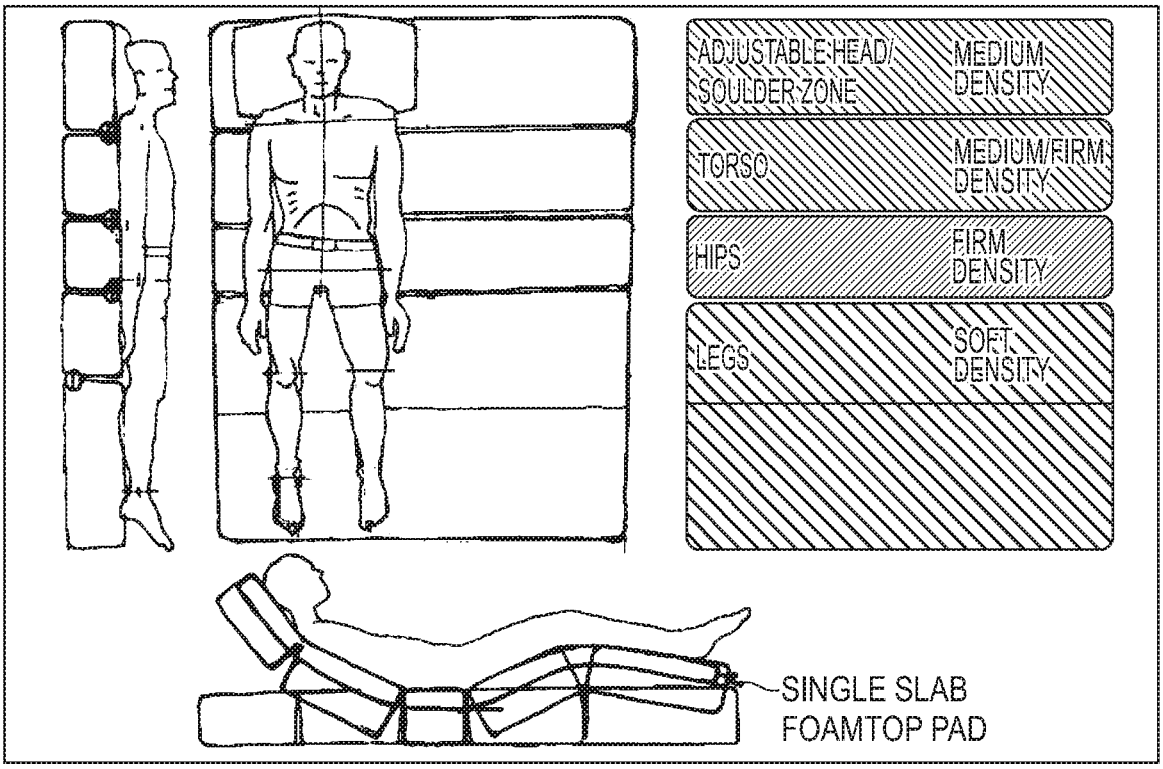
FIG. 17C shows details concerning zoning choices for the bedding system shown in FIG. 1.
Figure 17D:
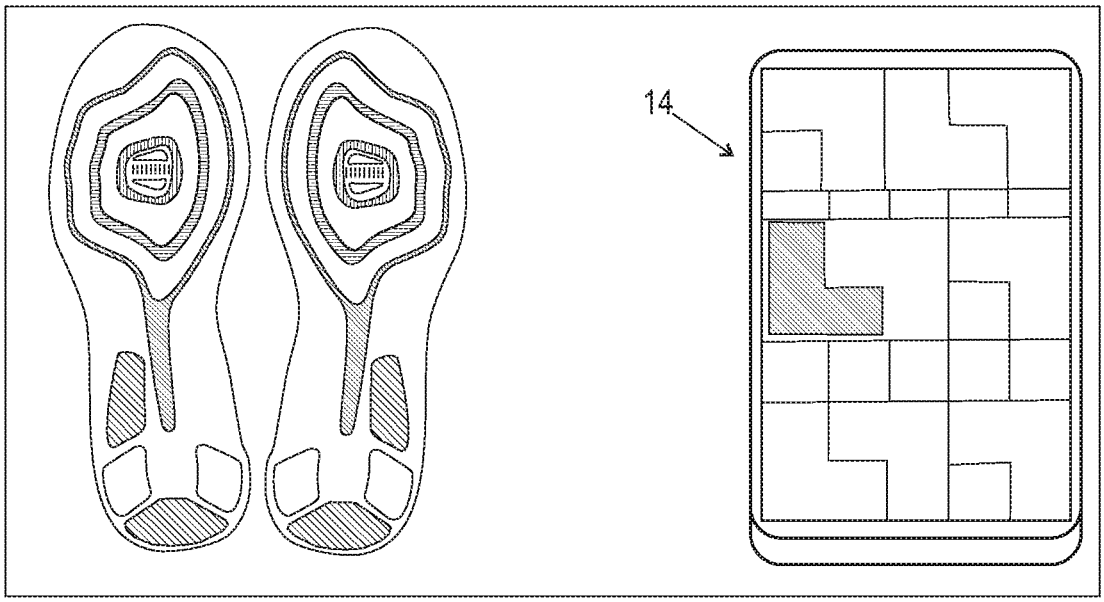
FIG. 17D shows details concerning zoning choices for the bedding system shown in FIG. 1.
Figures 1, 17E:
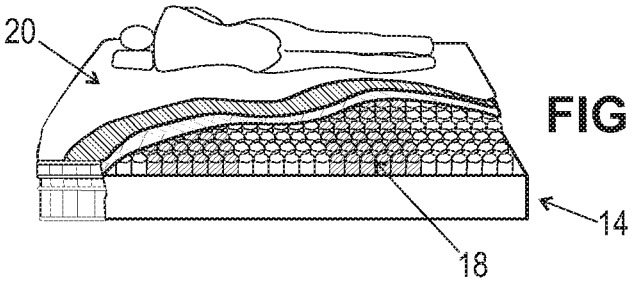
Figures 2, 17E:
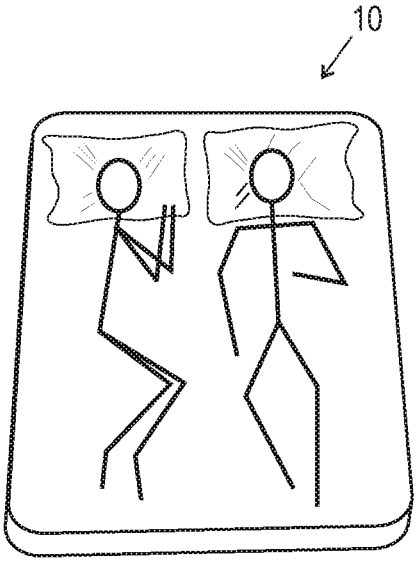
Figure 17F:
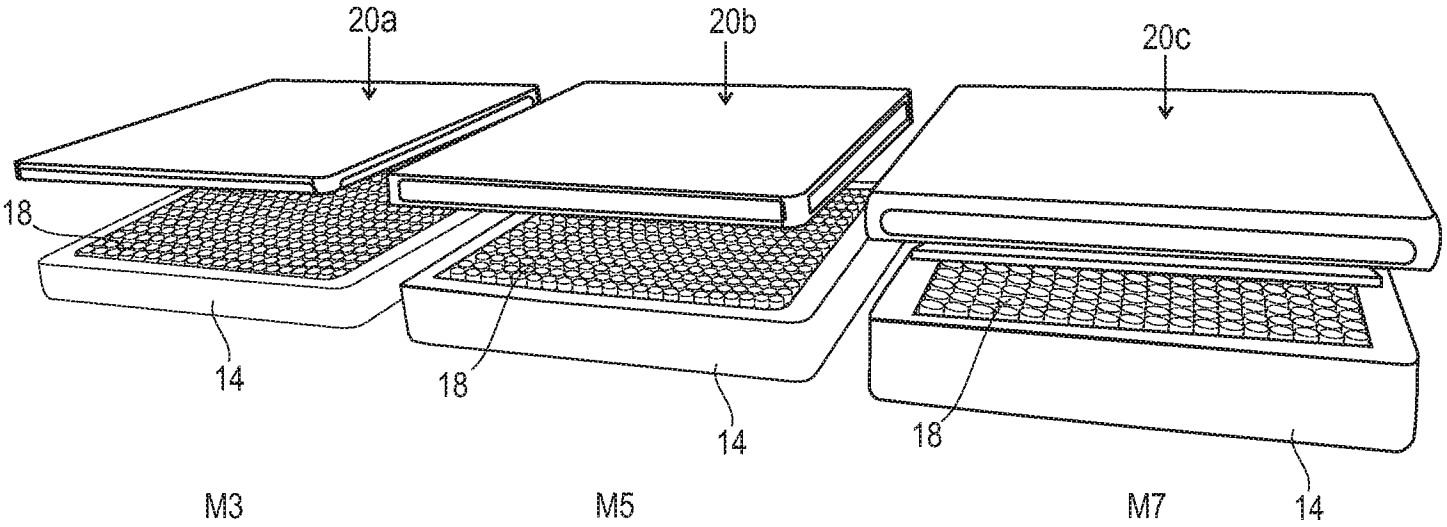
FIG. 17F shows perspective views of embodiments of the bedding system shown in FIG. 1.

In some embodiments, top pads 20 include a first top pad 20*a*, a second top pad 20*b* and a third top pad 20*c*, as shown in FIGS. 13A-13C. In some embodiments, top pads 20*a*, 20*b*, 20*c* are identical in terms of size and shape, but differ with regard to firmness. For example, top pad 20*b* may be firmer than top pad 20*a* and top pad 20*c* may be firmer than top pad 20*b*. In some embodiments, system 10 may include one or a plurality of additional top pads each having a firmness that is different than that of spring packs 18*a*, 18*b*, and 18*c*. In some embodiments, top pads 20*a*, 20*b*, 20*c* are formed from the same material. In some embodiments, top pads 20*a*, 20*b*, 20*c* are formed from different materials. In some embodiments, top pads 20*a*, 20*b*, 20*c* each have a different thickness, as shown in FIG. 17F.

Figure 13D:
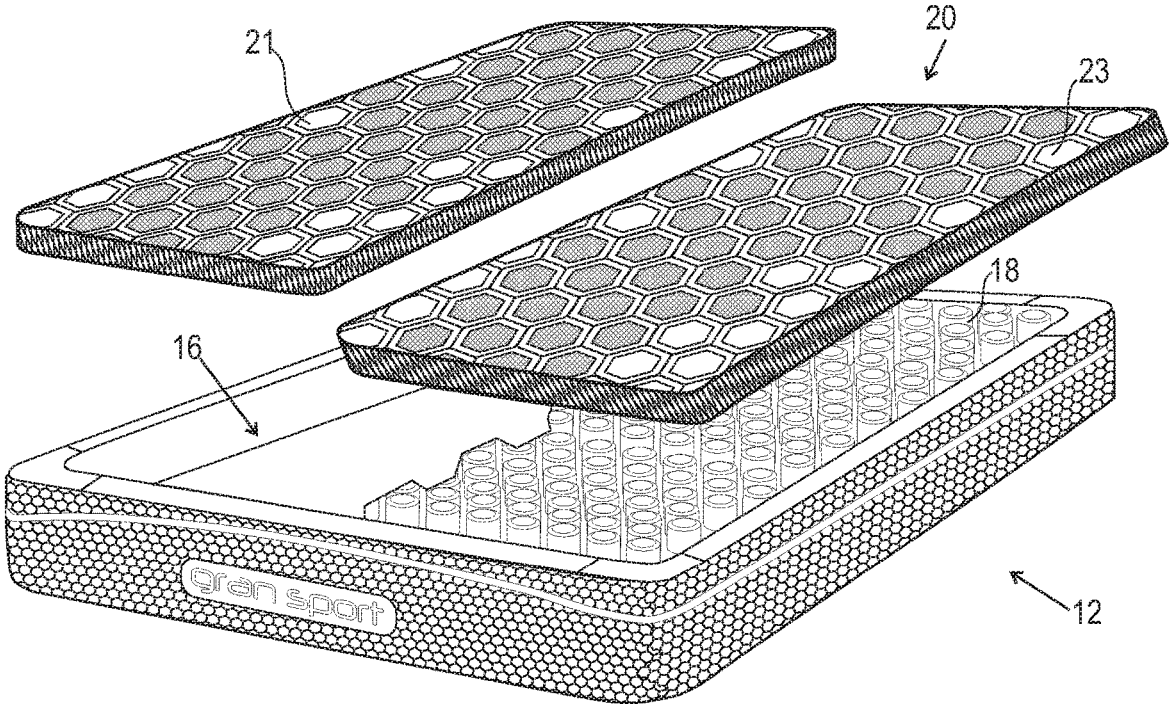
FIG. 13D is a perspective view of one embodiment of components of the bedding system shown in FIG. 1.
Figure 13E:
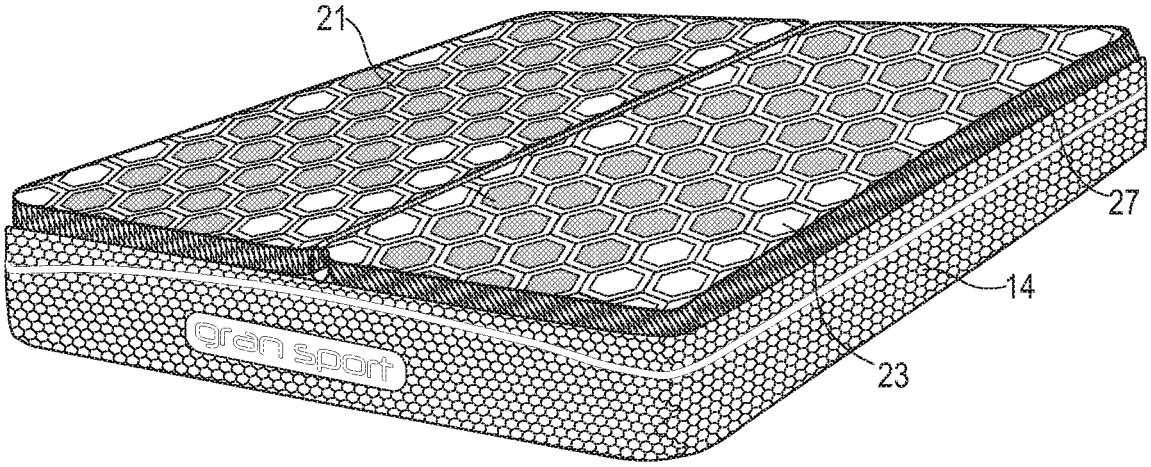
FIG. 13E is a perspective view of one embodiment of components of the bedding system shown in FIG. 1.

In some embodiments, top pad 20 includes a first side 21 and a second side 23 that is removably attached to first side 21, as shown in FIGS. 13D and 13E. In some embodiments, first and second sides 21, 23 may have different characteristics, such as, for example, different firmnesses, different thicknesses, different materials, materials with different textures, etc. In some embodiments, first and second sides 21, 23 are connected to one another via a zipper, hook and loop fasteners, Velcro®, magnets connectors, buttons, etc. In some embodiments, top pad 20 includes a band 27 that extends between upper and lower surfaces of top pad 20. Band 27 extends annularly or circumferentially about the perimeter of top pad 20, as shown in FIG. 13E. That is, band 27 perimetrically bounds the upper and lower surfaces of top pad 20. Band 27 is configured to show levels of breathability and firmness of top band 27. In some embodiments, the upper surface of top pad 20 has a honeycomb design.

Figure 13F:
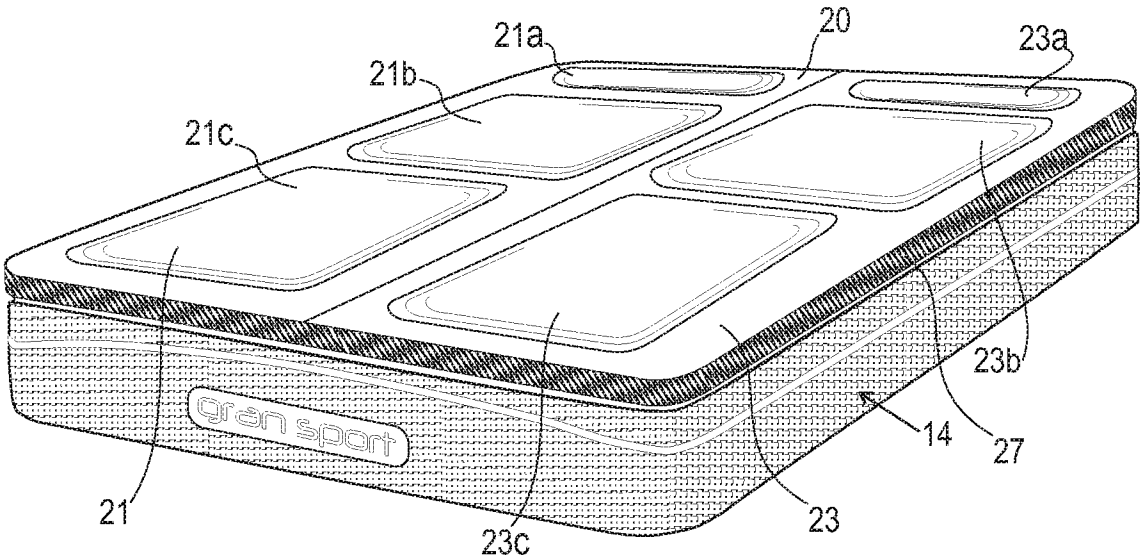
FIG. 13F is a perspective view of one embodiment of components of the bedding system shown in FIG. 1.

In one embodiment, shown in FIG. 13F, first side 21 includes zones 21*a*, 21*b*, 21*c* and side 23 includes zones 23*a*, 23*b*, 23*c*. At least one of zones 21*a*, 21*b*, 21*c* are different from another one of zones 21*a*, 21*b*, 21*c* as to firmness and at least one of zones 23*a*, 23*b*, 23*c* are different from another one of zones 23*a*, 23*b*, 23*c* as to firmness. Zones 21*a*, 21*b*, 21*c* may be the same or different than zones 23*a*, 23*b*, 23*c*.

Figure 14:
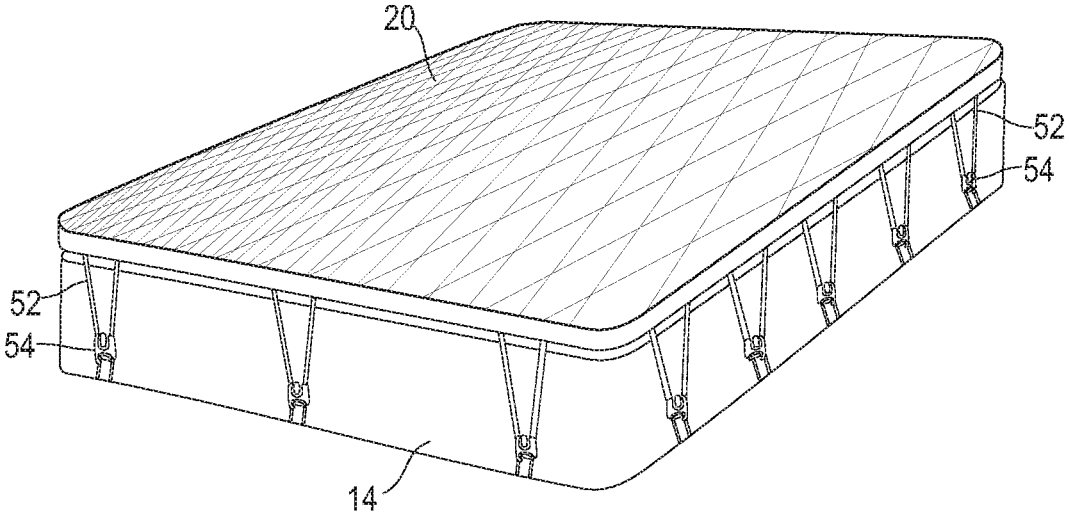
FIG. 14 is a perspective view of one embodiment of components of the bedding system shown in FIG. 1.

In one embodiment, shown in FIG. 14, top pad 20 is coupled to chassis 14 by carabineer style connections. In particular, top pad 20 includes a plurality of stretchable straps 52 each configured to connect to a buckle 54 on chassis 14. Straps 52 are fixed to top pad 20 and buckles 54 are fixed to chassis 14 such that connecting straps 52 with buckles 54 secures top pad 20 to chassis 14. In this embodiment, straps 52 have a loop-like configuration that is captured by a portion of buckle 54. Top pad 20 has a textured upper surface for comfort and pressure sensitivity and chassis 14 is made from a woven tent material. In some embodiments, top pad 20 is at least partially covered with a retention fabric to further secure top pad 20 to chassis 14. In some embodiments, the retention fabric entirely covers top pad 20. In some embodiments, the retention fabric entirely covers top pad 20 and at least a portion of chassis 14.

Figure 15:
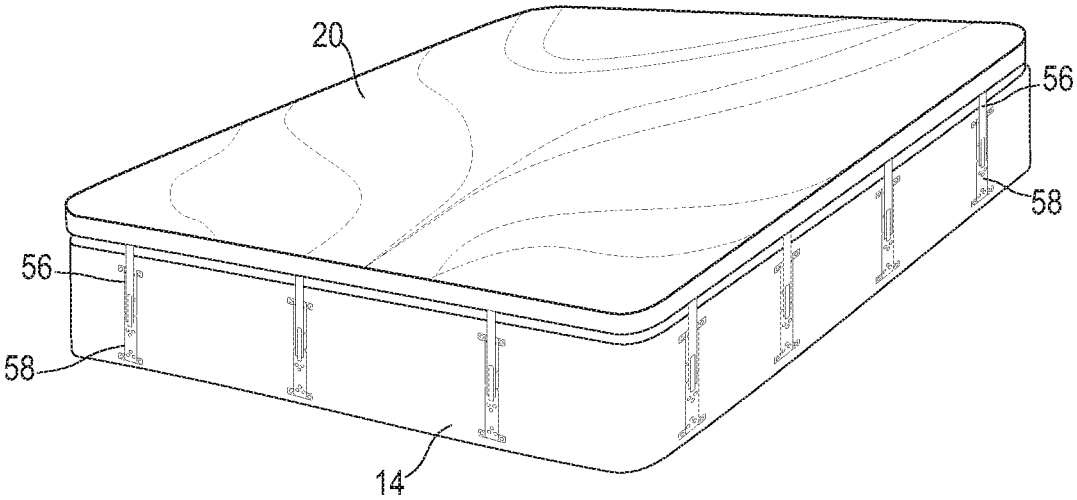
FIG. 15 is a perspective view of one embodiment of components of the bedding system shown in FIG. 1.

In one embodiment, shown in FIG. 15, top pads 20 are coupled to chassis 14 by hot rod strap style connections. In particular, top pad 20 includes a plurality of leather straps 56 each configured to connect to a buckle 58 on chassis 14. Straps 56 are fixed to top pad 20 and buckles 58 are fixed to chassis 14 such that connecting straps 56 with buckles 58 secures top pad 20 to chassis 14. In this embodiment, straps 56 each include at least one opening configured to receive a prong of buckle 58 similar to how a prong of a belt buckle is received within a hole of a belt.

Figure 15A:
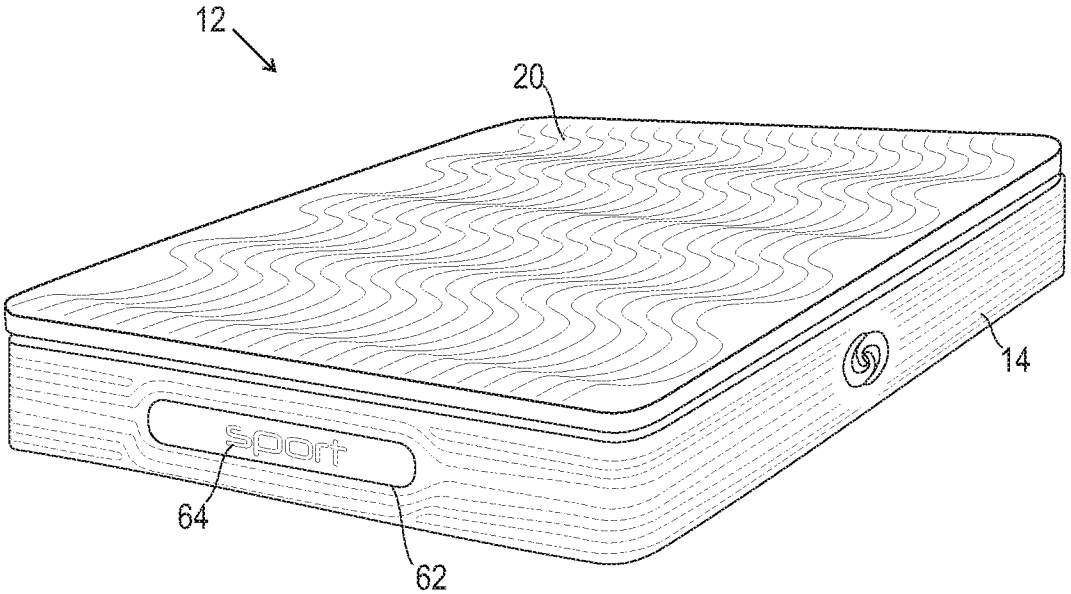
FIG. 15A is a perspective view of one embodiment of components of the bedding system shown in FIG. 1.
Figure 15B:
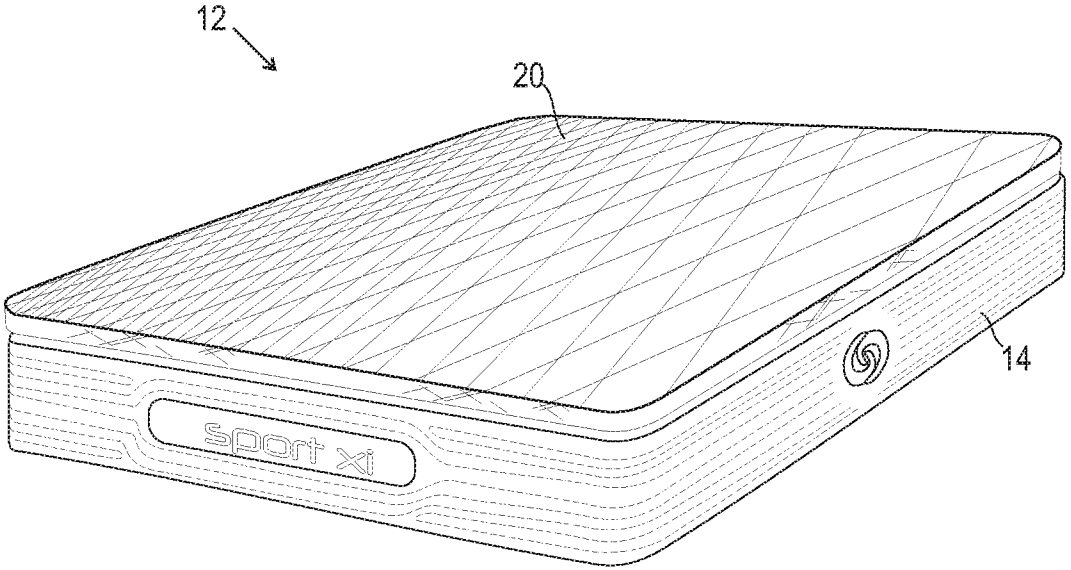
FIG. 15B is a perspective view of one embodiment of components of the bedding system shown in FIG. 1.
Figure 15C:
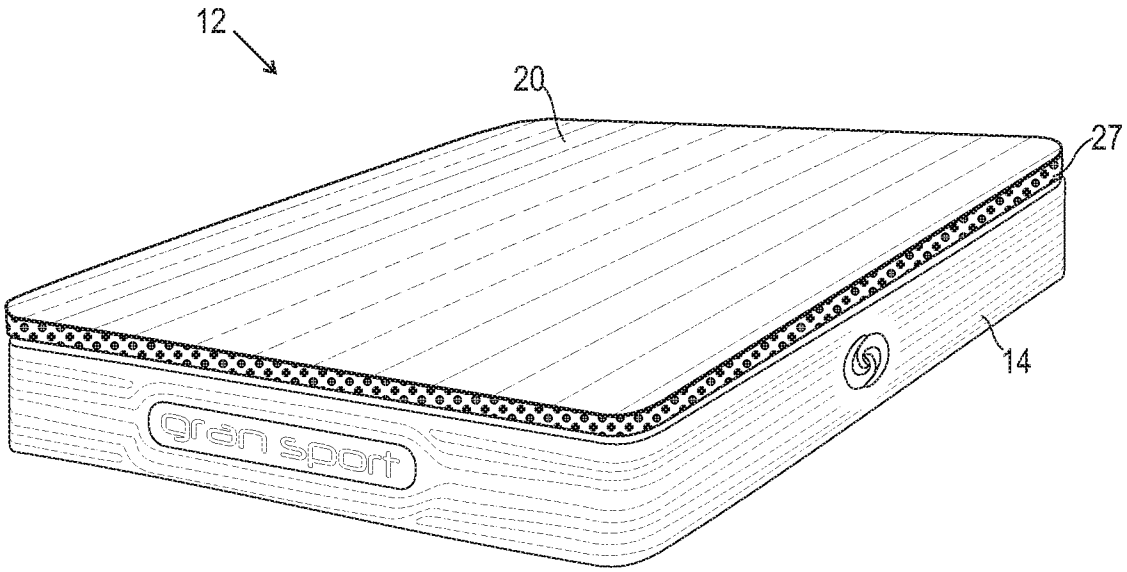
FIG. 15C is a perspective view of one embodiment of components of the bedding system shown in FIG. 1.

In one embodiment, shown in FIG. 15A, top pad 20 has a material surface texture for comfort and pressure sensitivity. Chassis 14 includes a woven dimensional material with a silver or white stitch. Chassis 14 includes a panel 62 toward the foot of mattress 12. In some embodiments, panel 62 includes indicia 64. Indicia 64 may be stitched onto panel 62 or may be otherwise coupled to panel 62 by adhesive or some other material. In some embodiments, indicia 64 includes letters that spell a model or other words describing characteristics of mattress 12. In one embodiment, indicia 64 includes letters that spell one or more words that describe top pad 20, such as, for example, characteristics of top pad 20. In one embodiment, indicia 64 includes letters that spell one or more words that describe the theme of mattress 12, such as, for example, words relating to racing, cars, camping, outdoors, etc. In one embodiment, shown in FIG. 15B, mattress 12 is stiffer than mattress 12 shown in FIG. 15A. Topper pad 20 in FIG. 15B is made from Patagonia style material for feel and durability. In one embodiment, shown in FIG. 15C, mattress 12 is stiffer than mattress 12 shown in FIG. 15B. Top pad 20 in FIG. 15C is made of a material surface to depict firm comfort.

Figure 15D:
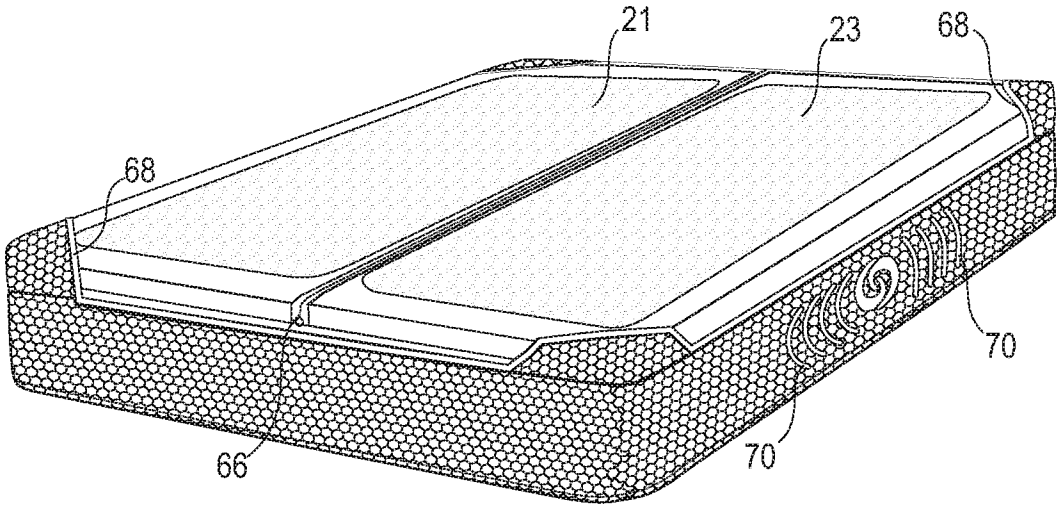
FIG. 15D is a perspective view of one embodiment of components of the bedding system shown in FIG. 1.

In one embodiment, shown in FIG. 15D, sides 21, 23 of top pad 20 each include color coded zones for comfort designation. Sides 21, 23 are joined together by a center zipper 66. Zippered corners 68 help to keep mattress 12 together. That is, zippered corners 68 secure top pad 20 to chassis 14, while maintaining spring packs 18 between chassis 14 and top pad 20. Chassis 14 includes one or a plurality of vents 70 that extend through inner and outer surfaces of chassis 14. Vents 70 may each have an arcuate configuration, as shown in FIG. 15D. Although vent 70 is shown in this configuration, other configurations such as, circular, elliptical, polygonal or the like are also possible. In some embodiments, at least one of base 22, first and second side portions 22*a*, 22*b* and top portion 22*c* includes one or more vents 70. Vents 70 are configured to allow air flow in and out of cavity 16. That is, vents 70 allow air to circulate and exchange from an inner core of mattress 12 to a room environment.

Figure 15E:
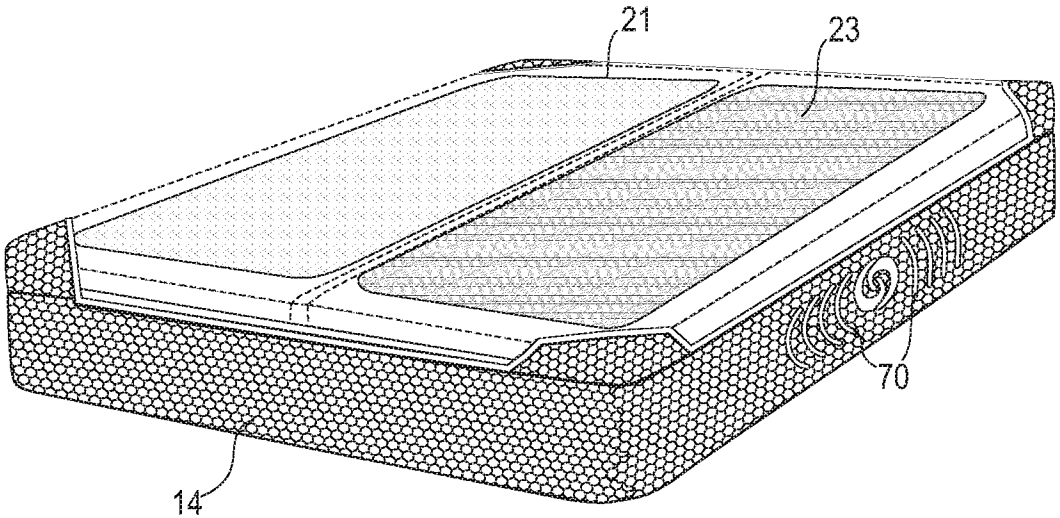
FIG. 15E is a perspective view of one embodiment of components of the bedding system shown in FIG. 1.
Figure 15F:
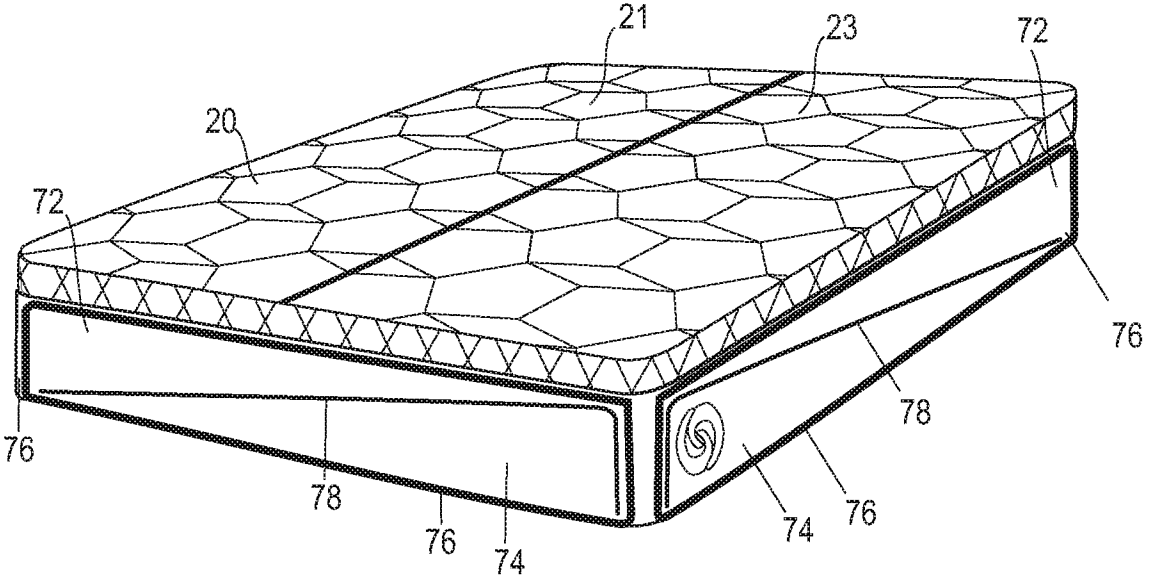
FIG. 15F is a perspective view of one embodiment of components of the bedding system shown in FIG. 1.

In one embodiment, shown in FIG. 15E, sides 21, 23 of top pad 20 are stitched together. Sides 21, 23 may be stitched together using a baseball style stitch. Band 27 (shown in FIG. 15C) is joined to the upper surface of top pad 20 using stitching. Likewise, band 27 is joined to the lower surface of top pad 20 using stitching. In some embodiments, the stitching that joins band 27 with the upper and lower surfaces of top pad 20 is a baseball style stitch. In one embodiment, shown in FIG. 15F, chassis 14 includes a first piece of material 72 and a second piece of material 74 that is joined with first piece of material 72 along seams 76. Second piece of material 74 is not joined to first piece of material 72 along seam 78 such that first and second pieces of material 72, 74 form a pocket. In some embodiments, the pocket is configured for holding sheets in place and/or storage. It is envisioned that one or more of base 22, first and second side portions 22*a*, 22*b* and top portion 22*c* may include a pocket. As shown in FIG. 15F, seam 78 extends at an acute angle relative to top pad 20 such that the depth of the pocket is greater at one end of the pocket than an opposite end of the pocket. However, in some embodiments, seam 78 extends parallel to top pad 20 such that the depth of the pocket is the same at one end of the pocket as the opposite end of the pocket.

Figure 16:
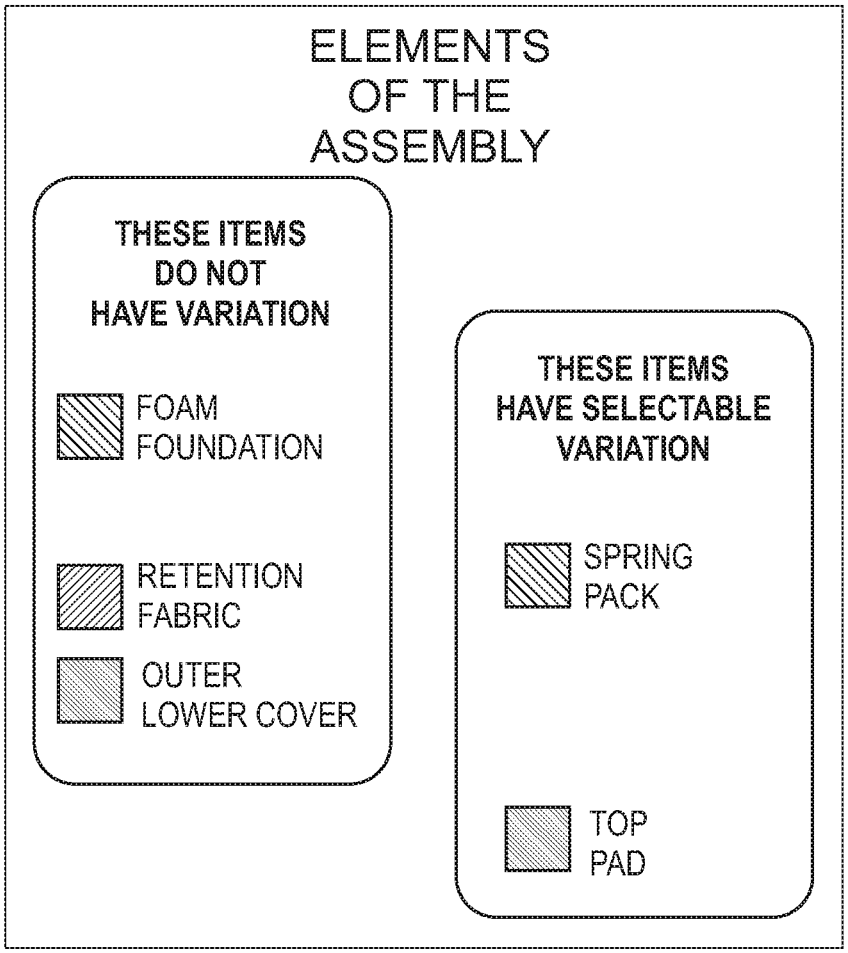
FIG. 16 is a schematic showing elements of assembly of the bedding system shown in FIG. 1.

As discussed above, mattress 12 is customizable according to the sleep position and/or body type of one or more sleepers. To achieve this, a plurality of spring packs 18 and top pads 20 having different firmnesses are available to be included in a given mattress 12, as shown in FIG. 16. This allows sleepers to choose spring packs 18 and top pads 20 having a firmness that correlates to their body type and/or sleep position. In some embodiments, only one type of chassis 14, only one type of outer lower covering 30 and only one type of retention fabric are available, as shown in FIG. 16. As such, mattress 12 may be customized by choosing spring packs 18 and top pads 20 having a firmness that correlates to their body type and/or sleep position and combining the same with chassis 14, outer lower covering 30 and/or the retention fabric.

In some embodiments, a plurality of different chassis 14 are available to build a mattress 12. For example, at least three types of chassis 14 may be provided, wherein each chassis 14 includes different zoning and/or materials, as shown in FIG. 17. In some embodiments, the different types of chassis 14 are assigned a numerical value for different ascending degrees of performance, materials, personal fit and durability, based upon body type. Three different chassis are shown in FIG. 17F. In some embodiments, chassis 14 is chosen from among the different types of chassis 14 based on the sleepers' body types and sleep positions. In some embodiments, the mattress category is based upon the number of zones in the mattress. For example, one of the categories may include mattresses that have one zone such that the mattress is universal from head to foot; one of the categories may include mattresses that have three zones from head to foot; and one of the categories may include mattresses that have five or more zones or have additional zoning custom molded to a sleeper's body, as shown in FIG. 17A. In some embodiments, the additional zoning is determined by sinking the sleeper into a waterbed-like structure and using 3D mapping so that every location on the mattress is zoned to the sleeper's specific body contours, similar to racing car seats and dental molding. Examples of the types of zones that may be included in chassis 14 are shown in FIGS. 17B and 17C. As shown in FIGS. 17B and 17C, the zones may be specifically positioned to provide a selected amount of support for a particular body part. As shown in FIG. 17D, chassis 14 may include a plurality of heated zones that may be variously positioned about chassis 14. In some embodiments, the heated zones are arranged similar to that of a sneaker tread pattern. As shown in FIGS. 17E1-E2, one side of mattress 12 may include a first zone or zones, such as, for example, a "his zone," and another side of mattress 12 may include a second zone or zones, such as, for example, a "her zone" that is/are different from the first zone or zones.

Figure 18:
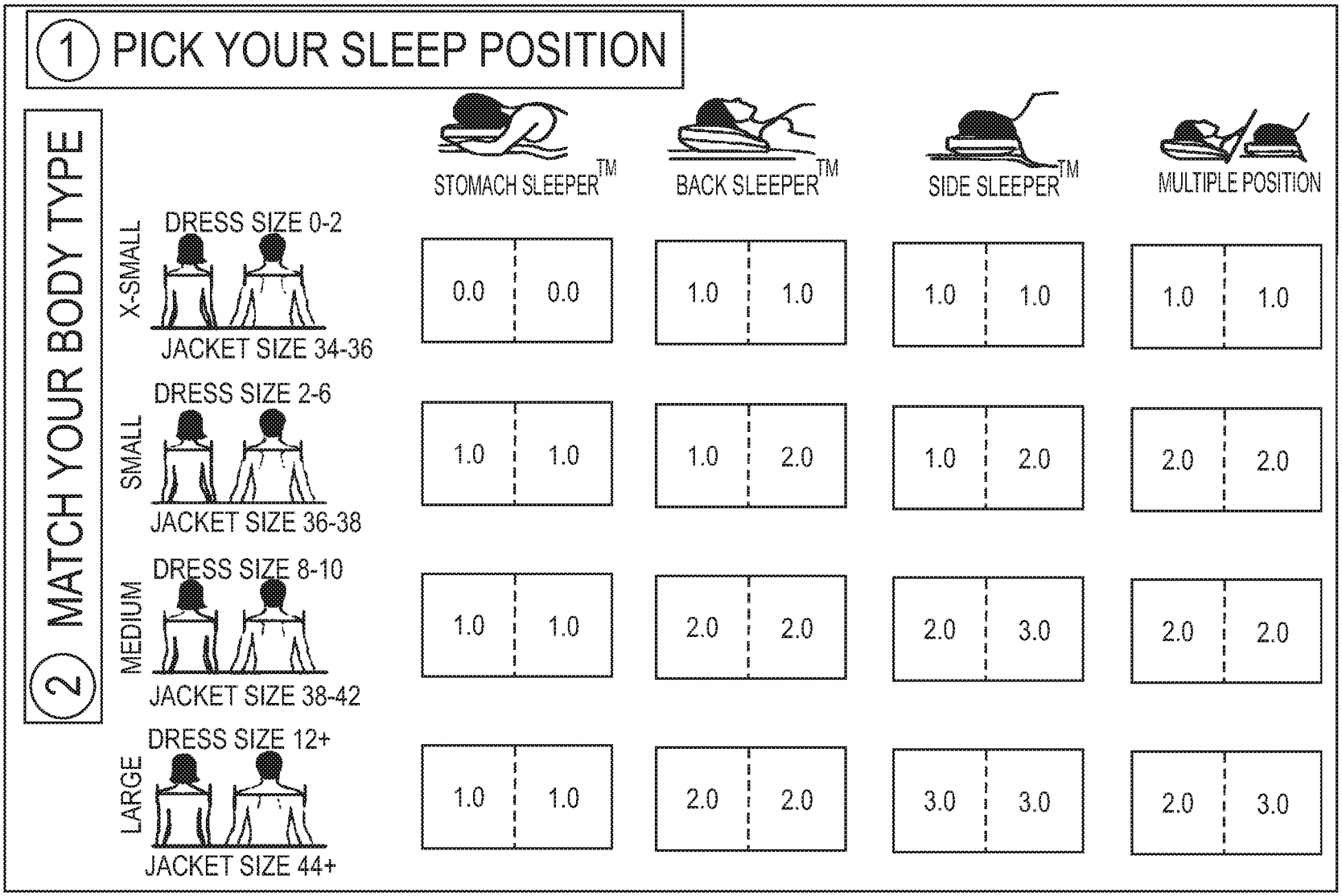
FIG. 18 shows a chart used to customize the bedding system shown in FIG. 1.
Figure 18A:
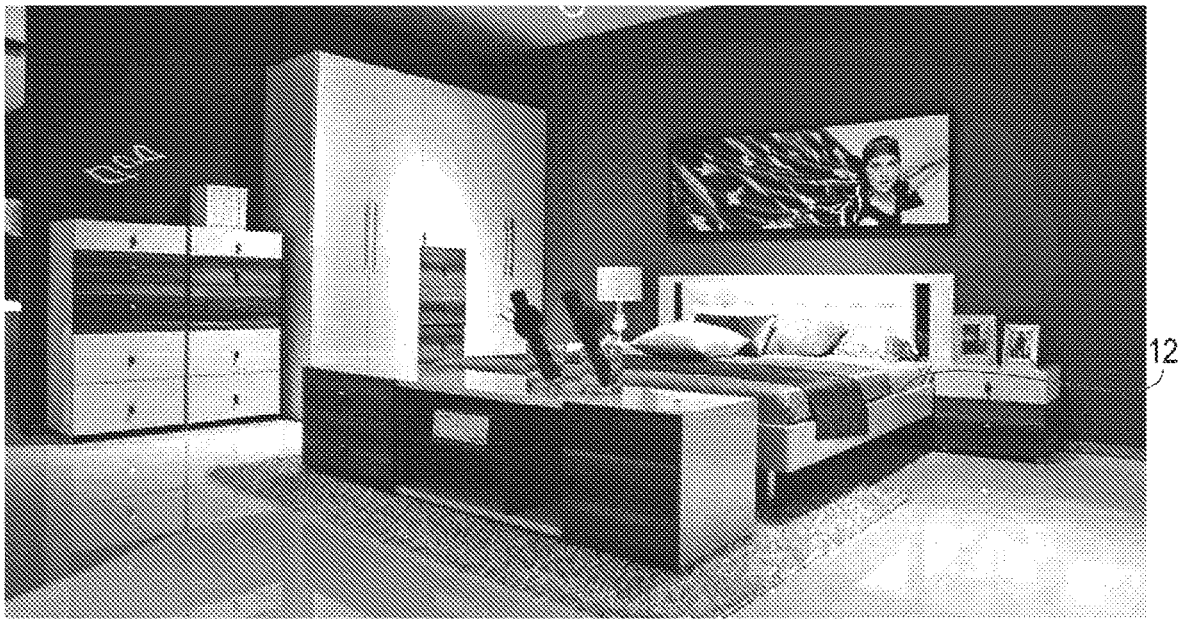
FIG. 18A is a perspective view of the bedding system shown in FIG. 1 in a retail setting.

Once the proper chassis 14 is selected, the sleeper then chooses spring packs 18 and a top pad 20 based on the sleepers' body types and sleep positions. In one embodiment, the sleeper may consult a chart similar to that shown in FIG. 18 that assigns a number based upon the sleepers' body types and sleep positions. For example, a sleeper with a small frame (dress size 0-2 or jacket size 34-36) who sleeps on their stomach may have a number 0.0, while a sleeper with a large frame (dress size 12+ or jacket size 44+) who sleeps on their stomach may have a number 3.0. This indicates that the sleeper with the large frame will require a firmer spring pack 18 and/or top pad 20 than the sleeper with the small frame. As such, the sleeper with the large frame would likely select spring pack 18*c* and the sleeper with the small frame would likely select spring pack 18*a*. Likewise, the sleeper with the large frame would likely select top pad 20*c* and the sleeper with the small frame would likely top pad 20*a*. As discussed above, spring packs 18*a*, 18*b*, 18*c* can be combined with any of spring packs 18*a*, 18*b*, 18*c* such that two spring packs 18 having the proper firmness can be selected for one mattress 12 so as to provide proper support for each of the two sleepers that sleeps on mattress 12. Although mattress 12 has been discussed in terms of chassis 14, spring packs 18*a*, 18*b*, 18*c* and top pads 20*a*, 20*b*, 20*c*, it should be understood that mattress 12 can include any of the chassis discussed in this disclosure, any of the spring packs discussed in this disclosure and any of the top pads discussed in this disclosure, in any combination. Indeed, the features or components of one embodiment discussed herein may be incorporated into any of the other embodiments discussed herein, thus providing a variety of options in forming a mattress that is specifically suited for a sleeper or sleepers. This is facilitated by, among other things, the modular nature of mattress 12. FIG. 18A shows an assembled mattress 12 in a retail setting, such as, for example, a showroom that has been adapted to appear like a typical bedroom, with a rug, furniture and decorations typically found in a bedroom.

Figure 19:
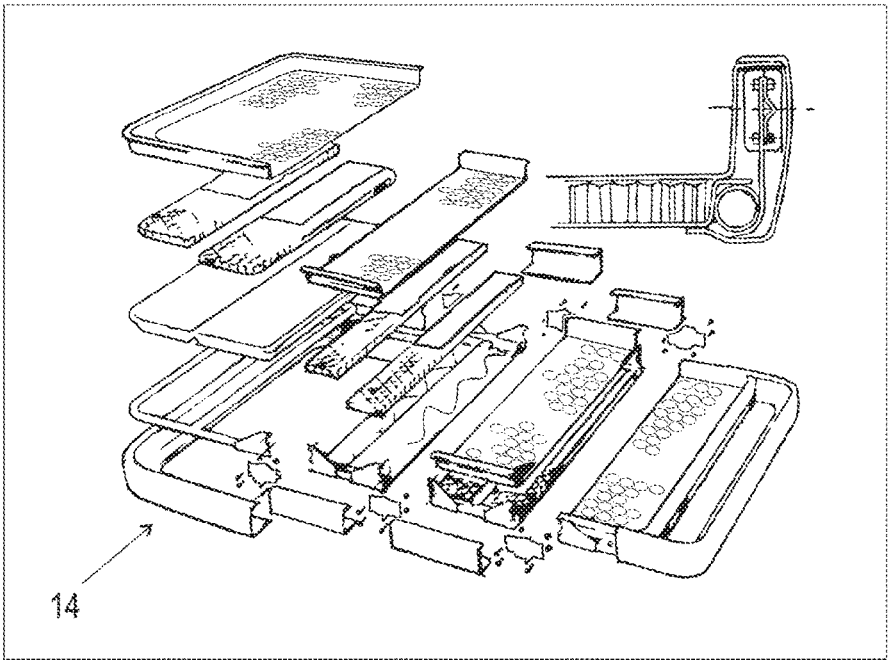
FIG. 19 is a perspective view of a bedding system in accordance with the present disclosure, with parts separated.
Figure 22:
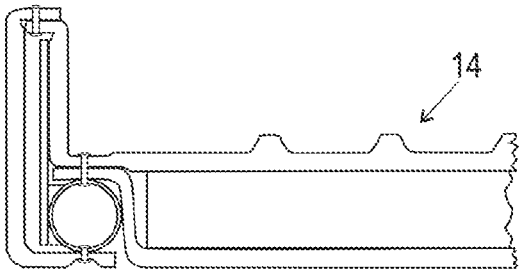
FIG. 22 is a side, cross sectional view of components of the bedding system shown in FIG. 19.
Figure 20A:
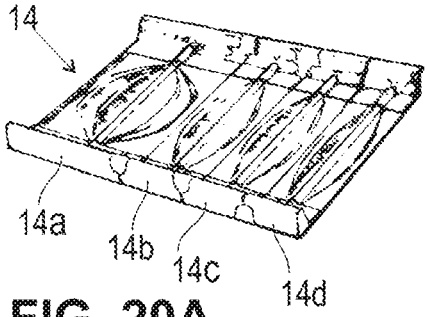
FIG. 20A is a perspective view of the bedding system shown in FIG. 19.
Figure 21:
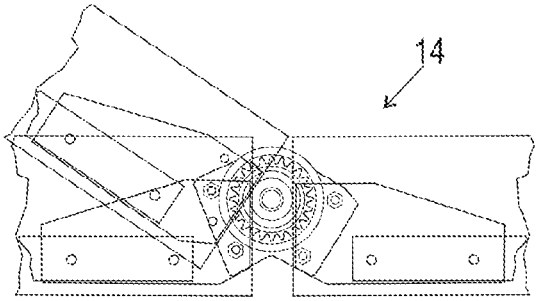
FIG. 21 is a side, breakaway view, in part phantom of components of the bedding system shown in FIG. 19.
Figure 20B:
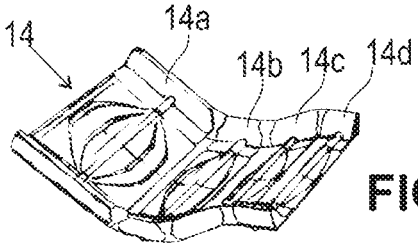
FIG. 20B is a perspective view of the bedding system shown in FIG. 19.

In one embodiment, shown in FIGS. 19-21, chassis 14 is powered for adjustability and/or articulation. Chassis 14 may be manual or electric. Motion devices may be embedded within chassis 14. In particular, chassis 14 may include at least four portions 14*a*, 14*b*, 14*c*, 14*d* that are movable relative to one another, as shown in FIGS. 20A and 20B. Portions 14*a*, 14*b*, 14*c*, 14*d* are connected to one another by rotatable gears (FIG. 21) that are configured to rotate portions 14*a*, 14*b*, 14*c*, 14*d* relative to one another such that portions 14*a*, 14*b*, 14*c*, 14*d* can move from a first position, shown in FIG. 20A, in which portions 14*a*, 14*b*, 14*c*, 14*d* extend parallel to one another to a second position, shown in FIG. 20B, in which portions 14*a*, 14*b*, 14*c*, 14*d* extend at acute angles relative to one another. In some embodiments, the rotatable gears are configured to lock to fix portions 14*a*, 14*b*, 14*c*, and 14*d* in the first position and/or the second position.

Figure 23:
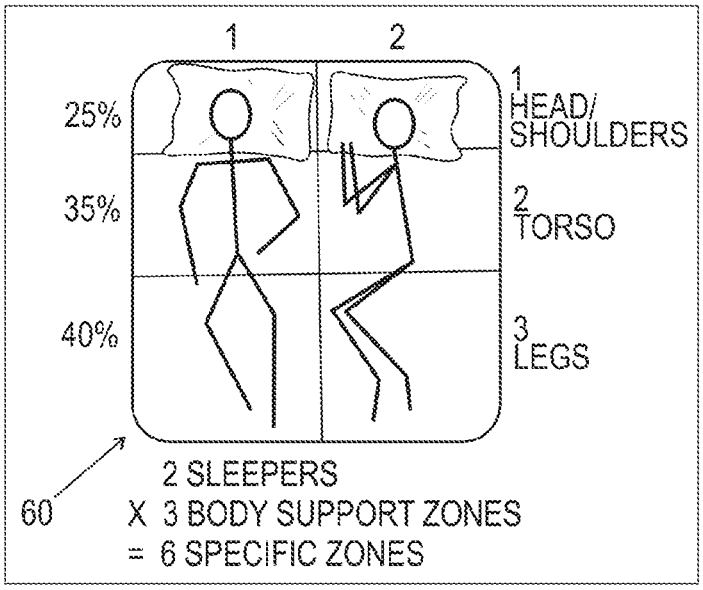
FIG. 23 is a top view of one embodiment of components of the bedding system shown in FIG. 1.
Figure 24:
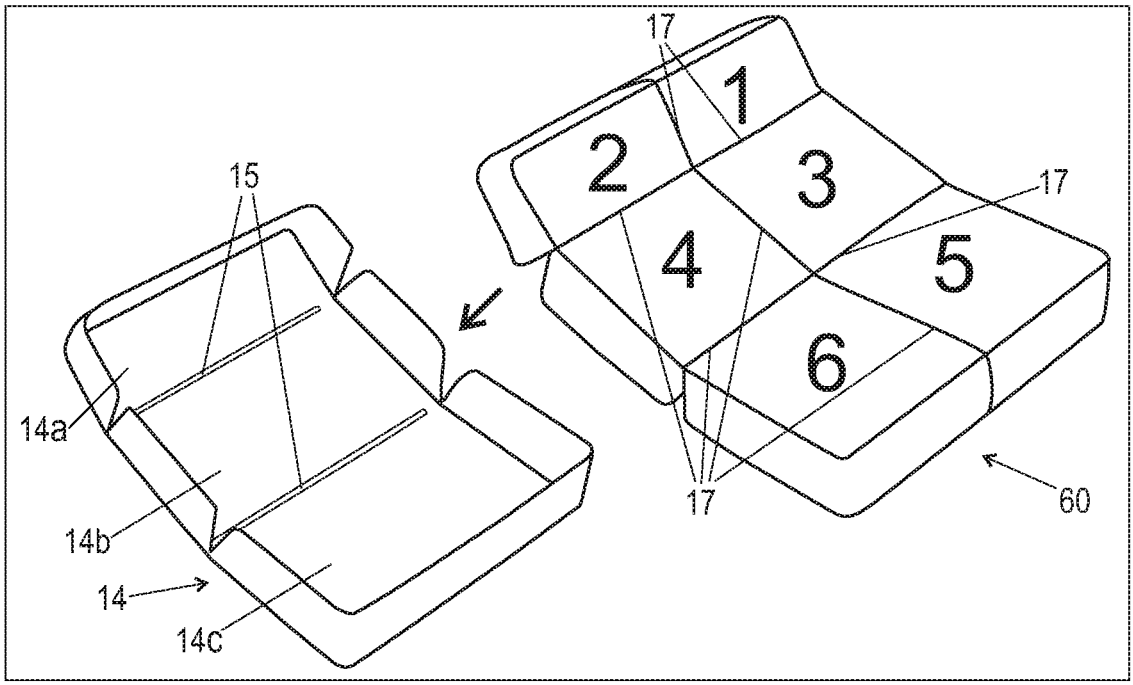
FIG. 24 is a perspective view of one embodiment of components of the bedding system shown in FIG. 1.
Figure 25:
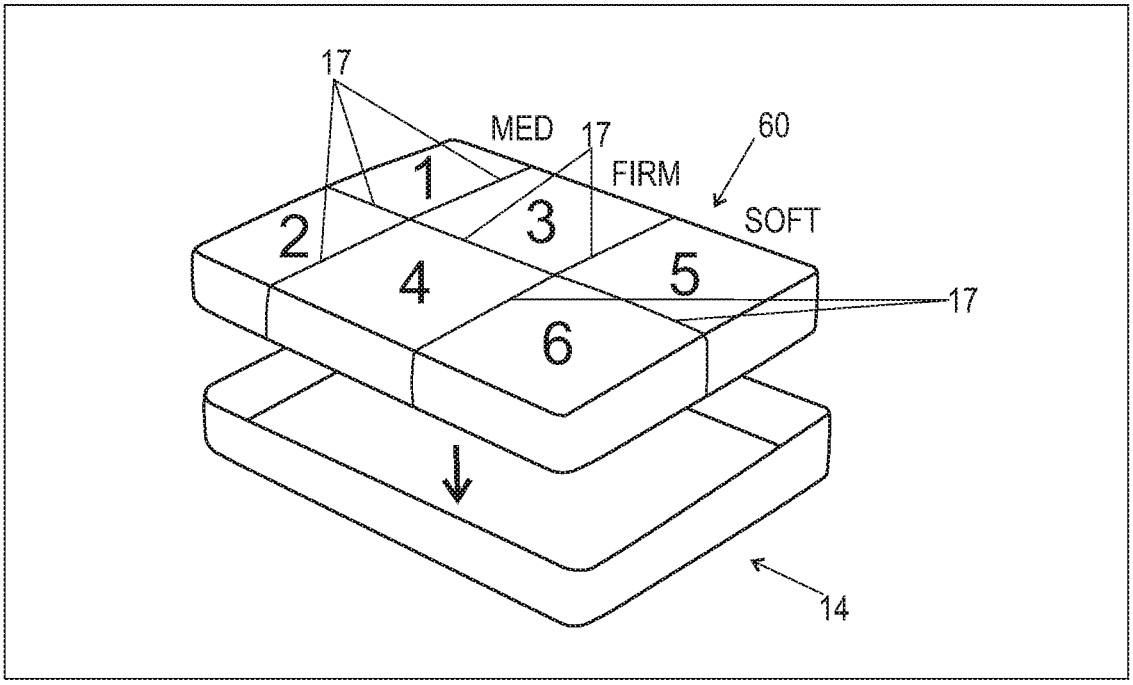
FIG. 25 is a perspective view of one embodiment of components of the bedding system shown in FIG. 1.

In one embodiment, shown in FIG. 23, mattress 12 has a six zone system. In one embodiment, shown in FIG. 24, chassis 14 includes at least three portions 14*a*, 14*b*, 14*c* that are joined to one another by hinges 15 such that portions 14*a*, 14*b*, 14*c* are movable relative to one another. Mattress 12 includes a cushion 60 positioned within cavity 16. Cushion 60 includes portions 1-6, as shown in FIG. 24. Portions 1-6 are joined to one another by hinges 17. This configuration allows mattress 12 to recline, while still providing multiple zones. In one embodiment, shown in FIG. 25, chassis 14 is a tray that does not articulate. In some embodiments, at least two of zones 1-6 have different characteristics, such as, for example, different firmnesses.

In some embodiments, system 10 includes an easy to ship/easy to carry packaging method, as shown in FIGS. 26 and 27, for transporting mattress 12. The method includes packaging mattress 12 in four boxes. In some embodiments, one box includes one spring pack 18, another box includes another spring pack 18, another box includes chassis 14 and another box includes top pad 20. In some embodiments, the easy to ship and/or easy to carry packaging method allows the modular pieces of the customizable mattress to be assembled at the moment of delivery by a retail store driver. In some embodiments, the easy to ship and/or easy to carry packaging method requires only a single driver, such as, for example, a delivery person, drone or UPS delivery to transport the modular pieces of the customizable mattress from a factory or warehouse to an end user. As shown in FIG. 27, the easy to ship/easy to carry packaging method includes assembling mattress 12. In particular, chassis 14, spring packs 18 and top pad 20 are unpacked from their respective boxes. Spring packs 18 are positioned within cavity 16 of chassis 14. Top pad 20 is positioned to cover spring packs 18 and portions of chassis 14.

Figures 28, 29:
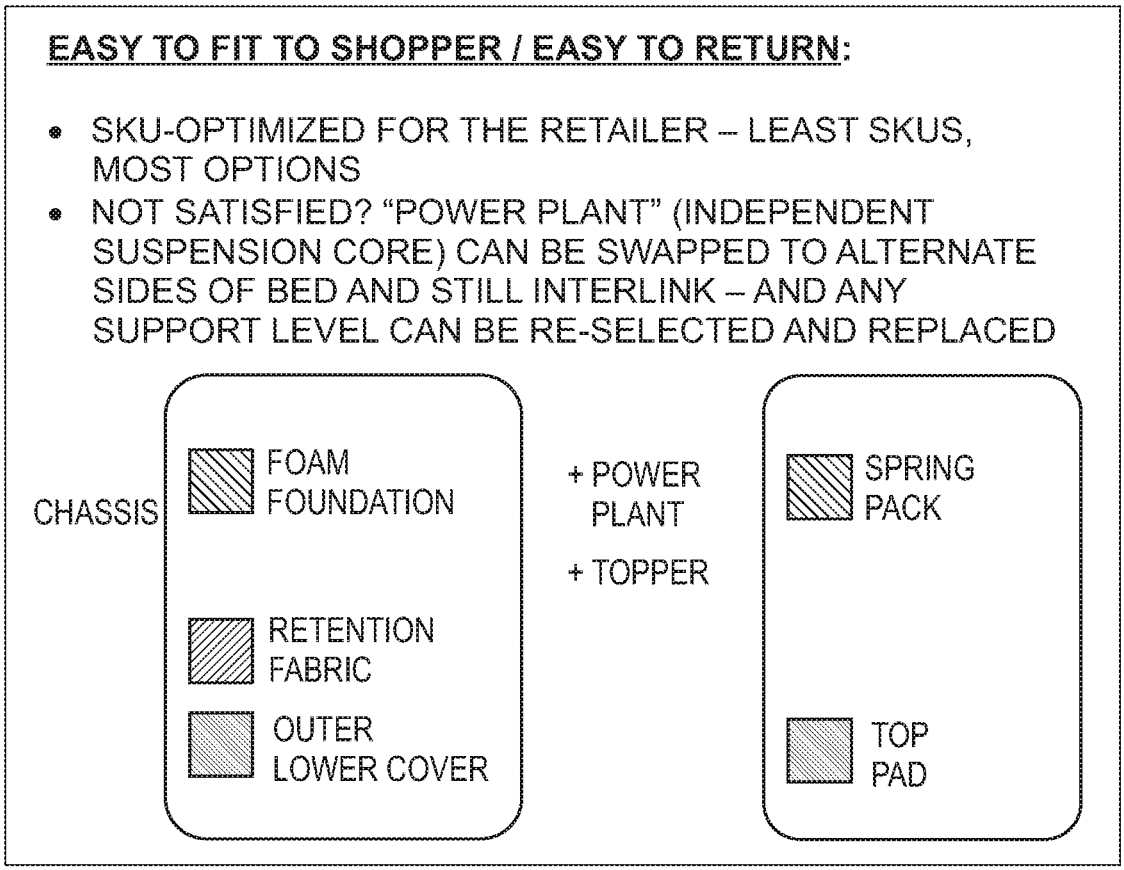
FIG. 28 shows details of a method used in connection with the bedding system shown in FIG. 1.
FIG. 29 shows details of a method used in connection with the bedding system shown in FIG. 1.

In some embodiments, system 10 includes an easy to fit to shopper/easy to return method, as shown in FIG. 28. The method includes providing an SKU optimized for a retailer. In some embodiments, the easy to fit shopper and/or easy to return method includes providing the least amount of SKUs, while providing the most options. In one embodiment, chassis 14 includes one SKU, each spring pack 18 includes one SKU and top pad 20 includes one SKU. Outer lower cover 30 and the retention fabric may each include one SKU, if used. The SKUs will help identify the components that are going to be used in a given mattress 12. For example, each of the different versions or embodiments of chassis 14 will have its own unique SKU, each of the different versions or embodiments of spring packs 18 will have its own Stock Keeping Unit (SKU) and each of the different versions or embodiments of top pad 20 will have its own SKU. This allows a worker to select the proper components by reading the SKUs. For example, this ensures the worker will choose the chassis 14, the spring packs 18 and the top pad 20 that each has the desired firmness or other characteristics selected by the consumer. In some embodiments, the easy to fit shopper and/or easy to return method includes swapping independent suspension cores or power plants to alternate sides such that the independent suspension cores still interlink. In some embodiments, the easy to fit shopper and/or easy to return method includes reselecting a support level.

In some embodiments, system 10 includes a subscription sales method that includes reaching out to customers based upon the date the customizable mattress was purchased (mattress birthday), as shown in FIG. 29. In some embodiments, the subscription sales method includes renewing the subscription. In some embodiments, the subscription sales method includes collecting customer information. In some embodiments, chassis 14 has a five year warranty, in which case, the subscription sales method will begin contacting a customer who purchased a mattress 12 regarding replacing or upgrading chassis 14 five years or more after mattress 12 was purchased. In some embodiments, top pad 20 has a one year warranty, in which case, the subscription sales method will begin contacting a customer who purchased a mattress 12 regarding replacing or upgrading top pad 20 one year or more after mattress 12 was purchased.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A customizable mattress, comprising:

a chassis defining a cavity;

a spring pack removably positioned within the cavity;

a top pad removably covering at least a portion of the spring pack, the top pad comprising opposite proximal and distal walls and first and second side walls extending from the proximal wall to the distal wall; and a plurality of flaps each defining a zippered corner of the mattress, the flaps being spaced apart from one another, the zippered corners being configured to secure the top pad to the chassis, the flaps each contacting a portion of a respective side wall and a portion of the proximal wall or the distal wall.

2. The mattress recited in claim 1, wherein the plurality of flaps comprises four flaps.

3. The mattress recited in claim 1, wherein the chassis comprises a body and material that covers at least a portion of the body, the material defining each flap.

4. The mattress recited in claim 3, wherein the body comprises a foam material.

5. The mattress recited in claim 1, wherein the chassis comprises a body and material that covers at least a portion of the body, the plurality of flaps comprising four flaps that are part of the material.

6. The mattress recited in claim 5, wherein the body comprises a foam material.

7. The mattress recited in claim 1, wherein the spring pack is divided into a first side configured to support a first sleeper and a second side configured to support a second sleeper, the first side being removably coupled to the second side.

8. The mattress recited in claim 1, wherein the spring pack is divided into a first side configured to support a first sleeper and a second side configured to support a second sleeper, the first side being removably coupled to the second side, the first side having a different firmness than the second side.

9. The mattress recited in claim 1, wherein the spring pack is divided into a first side configured to support a first sleeper and a second side configured to support a second sleeper, the first side being coupled to the second side by a zipper.

10. The mattress recited in claim 1, wherein the spring pack is divided into a first side configured to support a first sleeper and a second side configured to support a second sleeper, the first side being coupled to the second side by a zipper, the first side having a different firmness than the second side.

11. The mattress recited in claim 1, wherein the chassis comprises a wall including opposite inner and outer surfaces, the inner surface defining the cavity, the chassis comprising at least one vent that extends through the inner and outer surfaces.

12. The mattress recited in claim 11, wherein the includes a mesh material positioned therein.

13. The mattress recited in claim 1, wherein the chassis comprises opposite top and bottom walls and opposite first and second side walls each extending from the top wall to the bottom wall, inner surfaces of the walls defining the cavity, the chassis comprising a base layer extending continuously from the top wall to the bottom wall and from the first side wall to the second side wall, a bottom surface of the spring pack directly engaging the base layer.

14. The mattress recited in claim 1, wherein the chassis comprises opposite top and bottom walls and opposite first and second side walls each extending from the top wall to the bottom wall, inner surfaces of the walls defining the cavity, the chassis comprising a base layer extending continuously from the top wall to the bottom wall and from the first side wall to the second side wall, a bottom surface of the spring pack directly engaging the base layer.

15. The mattress recited in claim 1, wherein the spring pack comprises first and second spring packs each having a different firmness.

16. The mattress recited in claim 15, wherein the first spring pack is removably coupled to the second spring pack.

17. The mattress recited in claim 1, wherein the chassis comprises opposite top and bottom walls and opposite first and second side walls each extending from the top wall to the bottom wall, inner surfaces of the walls defining the cavity, the top pad being divided into a first portion configured to cover a first side of the spring pack and a second portion configured to cover a second side of the spring pack, the portions each extending continuously from a first end that engages the top wall to an opposite second end that engages the bottom wall, the second portion having a characteristic that is different than a characteristic of the first portion, the characteristics being selected from the group consisting of firmnesses, thicknesses and materials.

* * * * *